US007189486B2

(12) United States Patent
Kadota et al.

(10) Patent No.: US 7,189,486 B2
(45) Date of Patent: Mar. 13, 2007

(54) TONER AND IMAGE-FORMING APPARATUS USING THE SAME

(75) Inventors: Takuya Kadota, Hyogo (JP); Hidehiro Takano, Nagano (JP); Rie Miyazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 272 days.

(21) Appl. No.: 10/787,147

(22) Filed: Feb. 27, 2004

(65) Prior Publication Data

US 2004/0229149 A1 Nov. 18, 2004

(30) Foreign Application Priority Data

Feb. 28, 2003 (JP) ..... 2003-053831
Feb. 28, 2003 (JP) ..... 2003-053832

(51) Int. Cl.
*G03G 9/00* (2006.01)

(52) U.S. Cl. ..... 430/111.4; 399/252

(58) Field of Classification Search ..... 430/111.4; 399/252

See application file for complete search history.

(56) References Cited

U.S. PATENT DOCUMENTS

2004/0191656 A1* 9/2004 Ishiyama et al. ..... 430/106.1

FOREIGN PATENT DOCUMENTS

JP 10-171156 A 6/1998

* cited by examiner

*Primary Examiner*—Mark A. Chapman
(74) *Attorney, Agent, or Firm*—Sughrue Mion, PLLC

(57) ABSTRACT

The present invention provides a toner which can properly ensure elasticity and viscosity after transiting fixing nip, can improve surface smoothness of the fixing surface, fixing strength of a toner and transparency, low temperature fixing ability, and can prevent fattening of characters by using dynamic viscoelastic characteristics more conformable for actual toner behavior in fixation by heating, further provides an image-forming apparatus capable of forming a high quality image while enhancing low temperature fixing ability, realizing oil-less fixation and preventing offset of a toner.

4 Claims, 3 Drawing Sheets

TONER AND IMAGE-FORMING APPARATUS USING THE SAME

FIELD OF THE INVENTION

The present invention relates to the technical field of toners used for forming images of electrostatic images in electrophotography, electrostatic recording and electrostatic printing etc. by development to toner images and heat-fixing the toner images, and also relates to image-forming apparatus, e.g., copying machines, printers and facsimiles using the toner.

BACKGROUND OF THE INVENTION

As electrophotography, a method of forming an electrostatic charge image on a photosensitive material comprising a photoconductive substance, developing the electrostatic charge image by a toner carried on a developing roller, transferring the toner image developed on the photosensitive material directly to a recording medium, e.g., paper, or via an intermediate transfer substance, and fixing the toner image on the recording medium by a fixing roller, e.g., a heating roller, on the recording medium, e.g., paper, by press-heating is known.

The toners used in this method are required not to bring about a so-called low temperature or hot offset, i.e., the adhesion of melted toner on a heating roller, and also required to have excellent fixing ability such as great fixing strength of the toner image fixed on a recording medium.

In fixing using a heating roller, as the factors which control the fixing ability and the offset resistance of the toners, it is well known that the storage modulus G' and the loss modulus G" in dynamic viscoelastic characteristics of a toner have influence. Storage modulus G' and loss modulus G" are viscoelastic characteristics of a substance having general viscoelasticity defined by complex elastic modulus in vibration experiment, and the real number part of complex elastic modulus is called storage modulus G' and the imaginary number part is called loss modulus G", specifically, storage modulus is an index showing the degree of the elasticity of a toner and loss modulus is an index showing the degree of viscosity. The dynamic viscoelastic characteristics are characteristics having a temperature-dependency varying according to the temperature, a frequency-dependency varying according to the frequency, and a strain-dependency varying according to the strain, i.e., characteristics showing a linear region of behaving linearly according to temperature, frequency and strain, or a nonlinear region of behaving nonlinearly.

It is proposed to improve the fixing ability, offset resistance and blocking resistance of a toner image by expressing the melting state of a toner at fixing time in such dynamic viscoelastic characteristics of temperature-dependency of a toner (e.g., refer to patent literature 1).

That is, the toner in this proposal is the toner containing binder resins, colorants and release agents, and the proposal, intends, to improve low temperature fixing ability, offset resistance and blocking resistance of the toner by setting the temperature of the time when the ratio of loss modulus to storage modulus (G"/G'=tan δ) becomes 1.0 at the range of from 55 to 70° C., the elastic modulus at that time at $1.5\times10^8$ Pa or less, the ratio of storage modulus G' (40) to storage modulus G' (50) (G' (40)/G' (50)) at from 1.5 to 5.0, the ratio of storage modulus G' (50) to storage modulus G' (60) (G' (50)/G' (60)) at from 3 to 20, the ratio of storage modulus G' (70) to storage modulus G' (100) (G' (70)/G' (100)) at from 50 to 250, and the ratio of storage modulus G' (110) to storage modulus G' (140)(G' (110)/G' (140)) at from 2 to 20.

[Patent literature 1]

JP-A-10-171156 ("Abstract" etc.) (the term "JP-A" as used herein means an "unexamined published Japanese patent application").

In the above-described fixation by heating, toners come to show the behavior of a linear region (L1) before fixing nip (inlet), the behavior of a nonlinear region (NL) S at fixing nip part, and the behavior of a linear region (L2) at the outlet of fixing nip.

However, in the toner disclosed in patent literature 1, the dynamic viscoelasticity of temperature-dependency measured in a linear region is used. In the fixation by heating, as described above, mere application of the dynamic viscoelasticity of temperature-dependency measured in a linear region to the toner showing a linear region (L1)—a nonlinear region (NL)—a linear region (L2) behavior is not conformable to actual behavior of the toner at the time of heat-fixation. Therefore, it cannot be said that low temperature fixing ability and offset resistance of the toner are sufficiently and effectively improved.

Thus, it cannot be said that sufficient and effective improvement has been done by conventional improvement of fixing characteristics of toners, and there is plenty of scope for improvements of surface smoothness of the fixing surface, fixing strength of a toner, prevention of fattening of characters, transparency, low temperature fixing ability of toners.

The present invention has been done in view of these circumstances.

SUMMARY OF THE INVENTION

An object of a first aspect of the present invention (hereinafter referred to as "first invention") is to provide a toner which can properly ensure elasticity and viscosity after transiting fixing nip, can improve surface smoothness of the fixing surface, fixing strength of a toner and transparency, and can prevent fattening of characters by using dynamic viscoelastic characteristics more conformable for actual toner behavior in fixation by heating.

Another object of the first invention is to provide an image-forming apparatus capable of forming a high quality image while enhancing low temperature fixing ability.

An object of a second aspect of the present invention (hereinafter referred to as "second invention") is to provide a toner which can properly ensure elasticity and viscosity after transiting fixing nip, can improve more effectively fixing strength and transparency of a toner, and can prevent fattening of characters by using dynamic viscoelastic characteristics more conformable for actual toner behavior in fixation by heating.

Another object of the second invention is to provide an image-forming apparatus capable of forming a high quality image while enhancing low temperature fixing ability and oil-less fixation.

The present inventors made extensive investigations to solve the above-described problems and found that the problems can by solved by providing a toner comprising a binder resin and at least a colorant, wherein the toner has a specific storage modulus and/or a specific loss modulus in step strain measurement of from a linear region to a nonlinear region of viscoelastic characteristics. Thereby, dynamic viscoelastic characteristics of the toner are effectively utilized in fixation by heating, thus a toner more conformable to actual behavior of toner can be obtained.

That is, the above-described objects of the present invention have been achieved by providing the followings:

The first invention mainly relates to the following items.

(1) A toner comprising a binder resin and at least a colorant, wherein the toner has a variation of its storage modulus (G' (NL)) in a nonlinear region at 180° C. during 200 seconds, in step strain measurement of from a linear region to a nonlinear region of viscoelastic characteristics, of 100 dyn/cm$^2$ or less.

(2) The toner according to item 1, wherein the toner has loss modulus (G" (NL)) in a nonlinear region of from 1,500 to 5,000 dyn/cm$^2$.

(3) The toner according to item 1, wherein the toner contains a release agent in an amount of 4 parts by weight or less per 100 parts by weight of the binder resin.

(4) An image-forming apparatus comprising at least:

an image carrier on which an electrostatic latent image is formed;

a developing unit which develops the electrostatic latent image on the image carrier to form a toner image by a toner;

a transferring unit which transfers the toner image on the image carrier to a recording medium; and a fixing unit which fixes the toner image transferred to the recording medium by heating, wherein the toner is the toner according to any one of items 1 to 3, wherein the fixing unit has a belt.

The second invention mainly relates to the following items.

(5) A toner comprising a binder resin and at least a colorant, wherein the toner has a loss modulus (G" (NL)) in a nonlinear region at 180° C., in step strain measurement of from a linear region to a nonlinear region of viscoelastic characteristics, of from 1,000 to 4,000 dyn/cm$^2$.

(6) The toner according to item 5, wherein the toner contains a release agent in an amount of 4 parts by weight or less per 100 parts by weight of the binder resin.

(7) The toner according to item 5, wherein the binder resin does not contain any crosslinked component.

(8) An image-forming apparatus comprising at least:

an image carrier on which an electrostatic latent image is formed;

a developing unit which develops the electrostatic latent image on the image carrier to form a toner image by a toner;

a transferring unit which transfers the toner image on the image carrier to a recording medium; and a fixing unit which fixes the toner image transferred to the recording medium by heating, wherein the toner is the toner according to any one of items 5 to 7, wherein the fixing unit has oil-less two rollers.

DETAILED DESCRIPTION OF THE INVENTION

Figure 3:
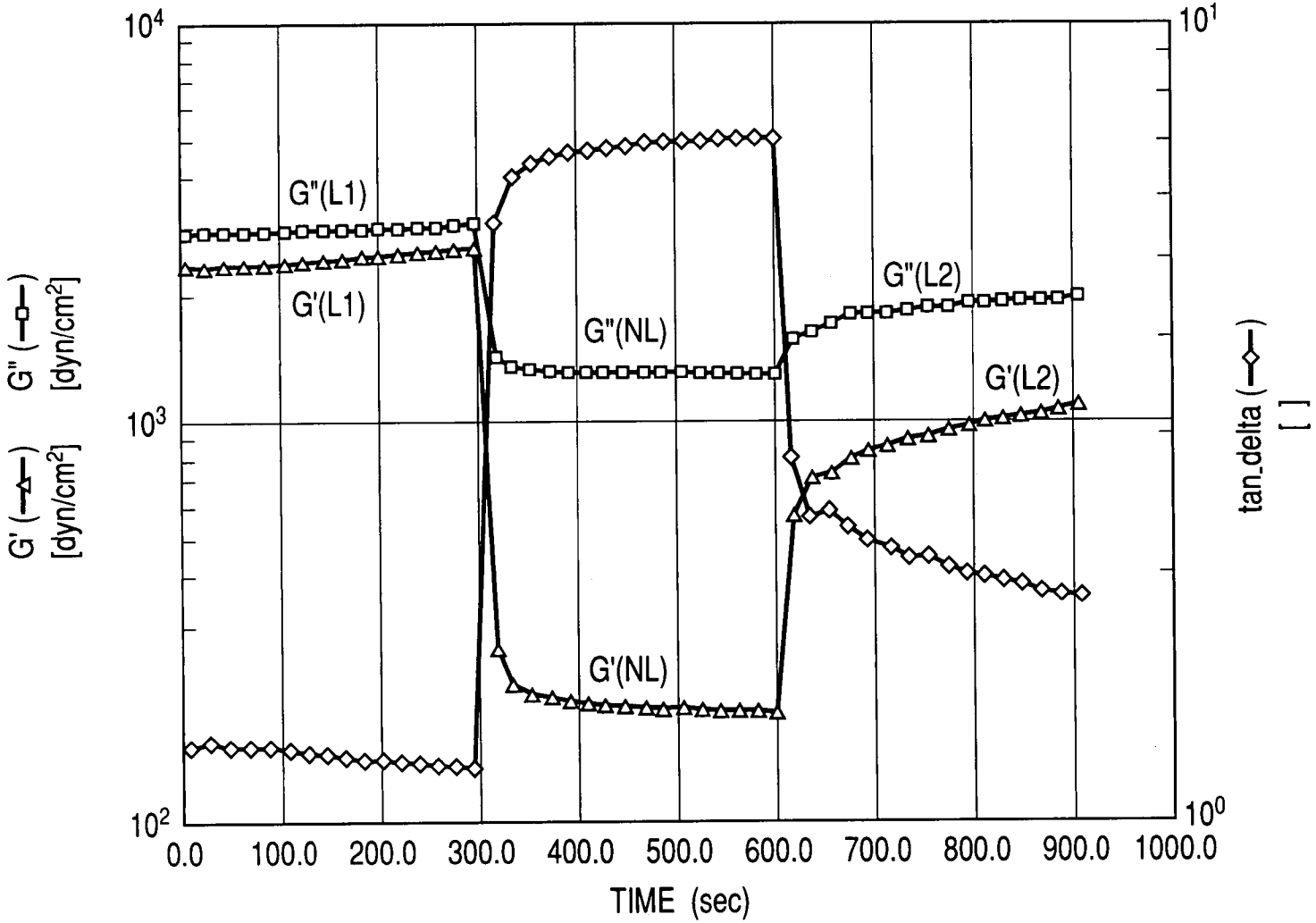
FIG. 3 is a drawing showing an example of the behavior of the toner of the present invention having the dynamic viscoelasticity of temperature-dependency before fixing nip at fixing nip part, and at the outlet of fixing nip of a heating fixing unit.

The toner according to the present invention has a dynamic viscoelastic characteristic showing the behavior of a linear region (L1) before fixing nip (inlet), the behavior of a nonlinear region (NL) at fixing nip part, and the behavior of a linear region (L2) at the outlet of fixing nip. This dynamic viscoelastic characteristic is a characteristic of deformation dependency varying according to strain. For example, in the step strain measurement of a viscoelastic characteristic at 180° C. as shown in FIG. 3, in the toner in Experimental Examples described later, storage modulus G' dyn/cm$^2$ and loss modulus G" dyn/cm$^2$ show respectively the behaviors of linear G' (L1) dyn/cm$^2$ and G" (L1) dyn/cm$^2$ until 300 sec after starting the measurement, and in the next period of from 300 sec to 600 sec, storage modulus G' dyn/cm$^2$ and loss modulus G" dyn/cm$^2$ show respectively the behaviors of nonlinear G' (NL) dyn/cm$^2$ and G" (NL) dyn/cm$^2$ with the increase of the amount of strain, and in the next period of from 600 sec to 900 sec, storage modulus G' dyn/cm$^2$ and loss modulus G' dyn/cm$^2$ show respectively the behaviors of linear G' (L2) dyn/cm$^2$ and G" (L2) dyn/cm$^2$, by making the strain amount the same with the strain amount L1.

A viscoelasticity regulated in the present invention can be provided by regulating molecular weight, molecular weight distribution, degree of cross-linkage and molecular structure of a resin in the toner of the present invention.

The binder resin in the toner of the first invention is prepared so that the variation of the storage modulus (G' (NL)) in a nonlinear region at 180° C. during the given time of 200 seconds is 100 dyn/cm$^2$ or less in step strain measurement of from a linear region to a nonlinear region of viscoelastic characteristics.

In the toner of the first invention having such a constitution, a linear region and a nonlinear region of dynamic viscoelastic characteristics of the strain dependency of the toner are effectively utilized in fixation by heating, thus a toner more conformable to actual behavior of toner can be obtained In that case, storage modulus G' (NL) becomes small and loss modulus G" (NL) becomes large in a nonlinear region. Accordingly, when the variation of the storage modulus G' (NL) during 200 seconds is smaller than 12 dyn/cm$^2$, the elasticity becomes small, since the elastic characteristics of the toner hardly vary. As a result, fine lines are squeezed and fattening of characters occurs in fixation by heating. Therefore, the variation is preferably 12 dyn/cm$^2$ or higher. When the variation of G' (NL) during 200 seconds is greater than 100 dyn/cm$^2$, a toner is affected by the temperature variation in fixing nip and a problem arises in the uniformity of the surface smoothness of a fixing surface Therefore, according to the toner of the first invention, elasticity and viscosity after transiting fixing nip can be appropriately ensured, and it becomes possible to effectively improve both the surface smoothness of a fixing surface and fixing strength of a toner.

In particular, the loss modulus G" (NL) in a nonlinear region of the toner of the first invention is prepared at from 1,500 to 5,000 dyn/cm$^2$, by which elasticity and viscosity can be securely obtained, appropriate fixing strength can be obtained in fixation by heating, fine lines are not squeezed, and fattening of characters can be effectively prevented.

In addition, when the content of a release agent is more than 4 parts by weight per 100 parts by weight of the binder resin, transparency is impeded, therefore, the content of a release agent in the toner of the first invention is prepared at 4 parts by weight or less, to thereby improve transparency.

The toner of the second invention is prepared so that the loss modulus (G" (NL)) in a nonlinear region at 180° C. is from 1,000 to 4,000 dyn/cm$^2$ in step strain measurement of from a linear region to a nonlinear region of viscoelastic characteristics.

In the toner of the second invention having such a constitution, a linear region and a nonlinear region of dynamic viscoelastic characteristics of the strain dependency of the toner are effectively utilized in fixation by heating, thus a toner more conformable to actual behavior of toner can be obtained.

In that case, when the loss modulus (G" (NL)) is greater than 4,000 dyn/cm$^2$, the elasticity becomes too great, so that there arises a problem in fixing strength. On the other hand, when the loss modulus (G" (NL)) is smaller than 1,000 dyn/cm$^2$, fine lines are squeezed and fattening of characters occurs in fixation by heating Therefore, according to the toner of the second invention, elasticity and viscosity after transiting fixing nip can be appropriately ensured, and it becomes possible to effectively improve both the surface smoothness of a fixing surface and fixing strength of a toner.

In particular, when the content of a release agent is more than 4 parts by weight per 100 parts by weight of the binder resin, transparency is impeded, therefore, the content of a release agent in the toner of the second invention is prepared at 4 parts by weight or less, to thereby improve transparency.

Further, when the binder resin of a toner contains a crosslinked component, the reductions of fixing strength, surface smoothness and transparency are brought about, so that it is preferred that the binder resin of the toner of the second invention should not contain a crosslinked component.

As the binder resins which are used in the present invention and capable of controlling viscoelastic characteristics in a fixing region, binder resins having both a crystalline region and an amorphous region are preferably used, e.g., resins having a urethane bond and a urea bond, resins comprising the blend of a crystalline polyester resin and an amorphous polyester resin, and polyester resins comprising a block copolymer of a crystalline part and an amorphous part, are exemplified. Amorphous polyester and block polyester are particularly preferably used as the binder resins.

Viscoelasticity can also be controlled with the compositions which are designed so that a polymerization of a binder resin in the toner progresses when heat energy is given in the range of fixing temperature, and the binder resin is crosslinked and the molecular weight increases by previously controlling the polymerization of the binder resin in conjunction with blending a polymerization initiator and/or a crosslinking initiator which exhibit their functions when heat energy higher than the prescribed quantity is given at fixing time.

The binder resin for use in the toner of the present invention comprises a polymer, and a polymer generally has a property of showing viscoelastic characteristics in a molten state of a toner. When a certain strain is given, the stress of the toner is relaxed with the time t (sec) in the stress relaxation measurement described later, so that the relaxation modulus G (t) [Pa], which is one of viscoelastic characteristics, shows a property of lessening with the relaxation time t (sec).

The toner of the invention is particularly described below with binder resins using well-known polyester resins as a binder resin in a toner having above-described viscoelasticity as an example.

The toner of the example comprises toner particles comprising a polyester resin containing a colorant and a charge controlling agent kneaded and pulverized. And the binder resin has functions of retaining colorant particles in toner particles, being softened by the heat and pressure of fixing rollers in fixation, and adhering the toner particles to a transfer material, e.g., paper. However, when the molecular weight of the binder resin is lowered and the softening temperature is lowered for the purpose of low temperature fixation, the reductions of glass transition temperature, strength, the retention of colorant, offset resistance, the strength of fixed images, and the storage stability are brought about.

Constitutional Components of Toner

The toner of the present invention can be manufactured with materials containing at least a resin as the main component (hereinafter sometimes referred to as merely "a resin").

Each component of the materials for use in manufacturing the toner of the invention is described below.

1. Resin (Binder Resin)

The resins (binder resins) in the present invention mainly comprise polyester resins. The content of polyester resins in the resins is preferably 50 wt. % or more, and more preferably 80 wt. % or more.

In general, polyester resins consist of an alcohol component (including those having 2 or more hydroxyl groups) and a carboxylic acid component (including divalent or higher carboxylic acids and derivatives thereof).

As the alcohol components, those having 2 or more hydroxyl groups can be used, such as chain diols, e.g., ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol (2,2-dimethylpropane-1,3-diol), 1,2-hexanediol, 2,5-hexane-diol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, cyclic diols, such as alkylene oxide adducts of bisphenol A, e.g., polyoxypropylene(2.2)-2,2-bis(4-hydroxyphenyl)-propane, polyoxypropylene(3.3)-2,2-bis(4-hydroxy-phenyl)propane, polyoxyethylene(2.0)-2,2-bis(4-hydroxy-phenyl)propane, polyoxypropylene-(2.0)-polyoxy-ethylene(2.0)-2,2-bis(4-hydroxyphenyl)propane, and polyoxypropylene(6)-2,2-bis(4-hydroxyphenyl)propane, 2,2-bis(4-hydroxycyclohexyl)propane, alkylene oxide adducts of 2,2-bis(4-hydroxycyclohexyl)propane, 1,4-cyclohexanediol, 1,4-cyclohexanedimethanol, hydrogenated bisphenol A, and alkylene oxide adducts of hydrogenated bisphenol A, and trivalent or higher polyhydric alcohols, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene are exemplified.

The alcohol components mainly comprising aliphatic diols having two hydroxyl groups are particularly used in the present invention. Further, the alcohol components may comprise aliphatic alcohols having three or more hydroxyl groups.

As the aliphatic alcohols having two or more hydroxyl groups, such as chain diols, e.g., ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol (2,2-dimethylpropane-1,3-diol), 1,2-hexanediol, 2,5-hexanediol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, and cyclic diols, e.g., 2,2-bis(4-hydroxycyclohexyl)propane, alkylene oxide adducts of 2,2-bis(4-hydroxycyclohexyl)-propane, 1,4-cyclohexanediol, 1,4-cyclohexanedimethanol, hydrogenated bisphenol A, and alkylene oxide adducts of hydrogenated bisphenol A are exemplified.

Thus in the present invention, the alcohol component mainly, comprises aliphatic diol, preferably 50 mol % or more of aliphatic diol, and more preferably 80 mol % or more of aliphatic diol.

As the carboxylic acid components, e.g., divalent or higher carboxylic acids, and derivatives thereof (e.g., acid anhydrides and lower alkyl esters) can be used, e.g., o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid, trimellitic acid pyromellitic acid and derivatives of these acids (e.g., anhydrides and lower alkyl esters) are exemplified.

In the present invention, it is particularly preferred that the carboxylic acid component comprise divalent dicarboxylic acid.

The examples of divalent carboxylic acids include e.g., o-phthalic acid (phthalic acid), terephthalic acid, isophthalic acid, succinic acid, adipic acid, sebacic acid, azelaic acid, octylsuccinic acid, cyclohexanedicarboxylic acid; fumaric acid, maleic acid, itaconic acid, and derivatives of these acids (e.g., anhydrides and lower alkyl esters).

In the present intention, it is particularly preferred to use polyester resins containing block polyesters and amorphous polyesters as described later. These polyester resins are described in detail-below.

1-1. Block Polyester:

Block polyester comprises a block copolymer having a crystalline block obtained by condensation of an alcohol component and a carboxylic acid component, and an amorphous block that is lower in crystallinity than the crystalline is block.

(1) Crystalline Block

As compared with amorphous blocks or amorphous polyesters, crystalline blocks are high in crystallinity. That is, the structure of molecular arrangement of crystalline blocks is strong and stable as compared with those of amorphous blocks or amorphous polyesters. Therefore, crystalline blocks contribute to the elevation of the strength of a toner as a whole. As a result, the toner finally obtained is strong in mechanical stresses and excellent in durability and storage stability.

Incidentally, highly crystalline resins generally have a so-called sharp melt property as compared with low crystalline resins. That is, highly crystalline resins have a property of exhibiting a sharp figure of endothermic peak as compared with low crystalline resins when subjected to the measurement of endothermic peak of melting temperature by differential scanning calorimetry (DSC).

On the other hand, as described above, crystalline blocks are high in crystallinity. Thus crystalline blocks have a function of imparting a sharp melt property to block polyesters. Therefore, the toner finally obtained can maintain excellent stability in figure at relatively high temperature (the temperature near the melting temperature of the block polyester) at which the amorphous polyester described later is sufficiently softened. Accordingly, when these block polyesters are used, a sufficient fixing ability (fixing strength) can be obtained in a broad temperature range.

Further, crystals having high hardness and appropriate sizes can be precipitated in a toner by the presence of these crystalline blocks. Due to such crystals, the stability of the figure of a toner becomes excellent, in particular stable to mechanical stresses. In addition, by the presence of these crystals in a toner, external additives, which are described later, can be surely retained around the surfaces of toner particles (mother particles) (external additives can be effectively prevented from being buried in mother particles), so that the functions of external additives (functions of imparting e.g., excellent flowability and electrification property) can be sufficiently exhibited.

The constitutional components of crystalline blocks are described below.

As the alcohol components constituting crystalline blocks, those having two or more hydroxyl groups can be used, preferably diol components having two hydroxyl groups. As such diol components having two hydroxyl groups, aromatic diols having an aromatic cyclic structure and aliphatic diols not having an aromatic cyclic structure are exemplified. As the aromatic diols, e.g., bisphenol A and alkylene oxide adducts of bisphenol A.(e.g., polyoxypropylene (2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane) are exemplified. As the aliphatic diols, such as chain diols, e.g., ethylene glycol, 1,3-propanediol, 1,2-propylene glycol, 1,3-propylene glycol, 1,4-butanediol, diethylene glycol, 1,5-pentane-diol, 1,6-hexanediol, dipropylene glycol, triethylene glycol, tetraethylene glycol, 1,2-propanediol, 1,3-butanediol, 2,3-butanediol, neopentyl glycol(2,2-dimethylpropane-1,3-diol), 1,2-hexanediol, 2,5-hexane-diol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, and cyclic diols, e.g., 2,2-bis(4-hydroxycyclohexyl)propane, alkylene oxide adducts of 2,2-bis(4-hydroxycyclohexyl)-propane, 1,4-cyclohexanediol, 1,4-cyclohexanedimethanol, hydrogenated bisphenol A, and alkylene oxide adducts of hydrogenated bisphenol A, are exemplified.

The diol components constituting crystalline blocks are not particularly restricted, but preferably at least a part of the diol components is aliphatic diol, more preferably aliphatic diol having 80 mol % or more of the diol components, and still more preferably aliphatic diol having 90 mol % or more. By this constitution, the crystallinity of block polyesters (crystalline block) can be heightened and the above effects can further be elevated.

The diol components constituting a crystalline block preferably have a straight chain molecular structure having from 3 to 7 carbon atoms, and diol components having hydroxyl groups at both terminals (diol represented by the formula: HO—$(C)_2H_n$—OH (provided that n is from 3 to 7)). Since crystallinity increases and friction coefficient lowers by containing these diol components, the resisting properties against mechanical stresses are improved and excellent durability and storage stability can be obtained. The examples of such diols include, e.g., 1,3-propanediol, 1,4-butanediol, 1,5-pentanediol and 1,6-hexanediol of these diols, 1,4-butanediol is preferred. By containing 1,4-butanediol, the above effects become particularly conspicuous.

When 1,4-butanediol is contained as the diol component constituting a crystalline block, it is more preferred that the diol-constituting a crystalline block has 50 mol % or more of 1,4-butanediol, and still more preferred that the diol constituting a crystalline block has 80 mol % or more of 1,4-butanediol. By this constitution, the above effects become further conspicuous.

As the carboxylic acid components constituting a crystalline block, divalent or higher carboxylic acids and derivatives thereof (e.g., acid anhydrides and lower alkyl esters) can be used. Of those carboxylic acid components, divalent dicarboxylic acids and derivatives thereof are preferably used. The examples of dicarboxylic acids include, e.g., o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid, and derivatives of these acids (e.g., anhydrides and lower alkyl esters).

The dicarboxylic acid components constituting a crystalline block are not particularly restricted, but it is preferred that the dicarboxylic acid components at least partially have a terephthalic acid skeleton, more preferably 50 mol % or more of the dicarboxylic acid components have a terephthalic acid skeleton, and still more preferably 80 mol % or more of the dicarboxylic acid components have a terephthalic acid skeleton. By this constitution, the toner finally obtained comes to be a toner well balanced in various characteristics required of the toner.

The content of the crystalline block in block polyester is not particularly restricted, but the content is preferably from 5 to 60 mol %, and more preferably from to 40 mol %. When the content of the crystalline block is less than the lower limit, there is the possibility that the effect by containing the crystalline block cannot be sufficiently exhibited according to the content of the block polyester. On the other hand, when the content of the crystalline block is higher than the upper limit, there is the possibility that the compatibility of block polyester and the amorphous polyester described later lowers, since the content of the amorphous block relatively lowers.

Crystalline block may contain components other than the above alcohol components and carboxylic acid components.

The average molecular weight (weight average molecular weight, Mw) of the block polyester containing-the crystalline block is not particularly limited, but it is preferably from $1\times10^4$ to $3\times10^5$, and more preferably from $1.2\times10^4$ to $1.5\times10^5$. When the average molecular weight, Mw, is less than the lower limit, there is the possibility that the mechanical strength of the finally-obtained toner lowers and sufficient durability (storage stability) cannot be obtained. When the average molecular weight Mw is too small, cohesive failure is liable to occur in the fixing of the toner, and the offset resistance tends to lessen. While when the average molecular weight Mw exceeds the upper limit, intercrystalline crack is liable to occur in the fixing of the toner, and the wettability to a transfer material (a recording medium), e.g., paper, lowers, as a result the quantity of heat required in fixing increases.

The glass transition temperature $T_g$ of block polyester is not particularly restricted, but it is preferably from 50 to 75° C., and more preferably from 55 to 70° C. When the glass transition temperature is less than the lower limit, the storage stability (heat resistance) of the toner decreases, and there are cases where fusing occurs among toner particles according to the use environment. On the other hand, when the glass transition temperature exceeds the upper limit, low temperature fixing ability and transparency decrease. When the glass transition temperature is too high, there is the possibility that the effect of the thermal treatment of sphere-making as described later cannot be sufficiently exhibited. Glass transition temperature can be measured in accordance with JIS K 7121.

The softening temperature of block polyester $T_{1/2}$ is not particularly restricted, but it is preferably from 90 to 160° C., and more preferably from 100 to 150° C. When the softening temperature is less than the lower limit, the storage stability of the toner lowers and there is the possibility that sufficient durability cannot be obtained. When the softening temperature is too low, cohesive failure is liable to occur in the fixing of the toner, and the offset resistance tends to lessen. While when the softening temperature exceeds the upper limit, intercrystalline crack is liable to occur in the fixing of the toner, and the wettability to a transfer material (a recording medium), e.g., paper, lowers, as a result the quantity of heat required in fixing increases. The softening temperature $T_{1/2}$ can be found as the temperature of the point on the flow curve corresponding to h/2 of the flow chart for analysis which can be obtained by measuring by using a flow tester on conditions of a sample amount of 1 g, pit of the die of 1 mm, length of the die of 1 mm, load of 20 kgf, preheating time of 300 seconds, temperature at starting of measurement of 50° C., and velocity of temperature-up of 5° C./min.

The melting temperature $T_m$ of block polyester (the central value $T_{mp}$ of the peaks in the measurement of the endothermic peak of melting temperature by differential scanning calorimetry as described later) is not particularly restricted, but it is preferably 190° C. or more, and more preferably from 190 to 230° C. When the melting temperature is less than 190° C., there is the possibility that the effect of improving offset resistance cannot be sufficiently obtained. While when the melting temperature is too high, it is required to increase the temperature of materials in the kneading process as described later. As a result, the ester exchange reaction of resin materials is liable to progress, and there are cases where the design of resin is difficult to be sufficiently reflected in the toner finally obtained. Melting temperature can be obtained, e.g., by the measurement of endothermic peak by differential scanning calorimetry (DSC).

When the toner finally obtained is used in a fixing unit having a fixing roller as described later, it is preferred to satisfy the relationship of $T_{fix} \leqq T_m$ (B) $\leqq (T_{fix}+100)$, more preferably to satisfy the relationship $(T_{fix}+10) \leqq T_m$ (B) $\leqq (T_{fix}+70)$, with the melting temperature of block polyester (the central value $T_m$ of the peaks in the measurement of the endothermic peak of melting temperature by differential scanning calorimetry as described later) as $T_m$ (B) [° C.], and the standard set surface temperature of the fixing roller as $T_{fix}$ [° C.]. By satisfying the relationship, the adhesion of the toner to the fixing roller of the fixing unit described later can be effectively prevented. Further, since block polyester has a property of making crystal of a proper size easily as described above, stability and durability can be maintained after fixation of the toner on a recording medium by satisfying the above relationship. Particularly when block polyester is used in combination with the amorphous polyester described later, the amorphous polyester can be sufficiently softened at fixing time. Accordingly, the fixing ability (fixing strength) of the toner on a recording medium can be satisfactorily elevated and the low temperature fixing ability of the toner can be excelled. In addition, since block polyester is liable to form crystals having high hardness, the obtained toner is excellent in the stability after fixation.

It is preferred that the melting temperature of block polyester be higher than the softening temperature of the later-described amorphous polyester. By this constitution, the toner finally obtained is improved in the stability of configuration and shows particularly excellent stability against mechanical stresses. Further; when the melting temperature of block polyester is higher than the softening temperature of the later-described amorphous polyester, e.g., in the thermal treatment of sphere-making as described later, the amorphous polyester can be thoroughly softened while ensuring the stability of configuration of the powders for manufacturing the toner in a certain degree by the block polyester. As a result, the thermal sphere-making treatment can be carried out efficiently, and the degree of circularity of the toner (toner particles) finally obtained can be made relatively high.

Incidentally, as described above, as block polyesters contain crystalline blocks having high crystallinity, they have a so-called sharp melt property as compared with relatively low crystalline resins (e.g., the later-described amorphous polyesters and the like).

As the index showing crystallinity, e.g., with the central value of the peak as $T_{mp}$ [° C.] and the shoulder peak value as $T_{ms}$ [° C.] in the measurement of endothermic peak of melting temperature by differential scanning calorimetry (DSC), the ΔT value represented by $\Delta T=T_{mp}-T_{ms}$ is exemplified. The smaller the ΔT value, the higher is the crystallinity.

The ΔT value of block polyester is preferably 50° C. or less, and more preferably 20° C. or less. The measuring conditions of $T_{mp}$ [° C.] and $T_{ms}$ [° C.] are not especially restricted, but the measurement is effected by increasing the temperature of the sample block polyester to 200° C. at a temperature-up velocity of 10° C./min, lowering the temperature at a temperature-down velocity of 10° C./min, and again at a temperature-up velocity of 10° C./min.

Block polyesters are higher in crystallinity than the amorphous polyesters described later. Accordingly, the relationship $\Delta T_A>\Delta T_B$ is satisfied, when the ΔT value of amorphous polyester as $\Delta T_A$ [° C.] and the ΔT value of block polyester as $\Delta T_B$ [° C.]. In particular in the present invention, it is preferred the relationship $\Delta T_A-\Delta T_B>10$ be satisfied, and it is more preferred that the relationship $\Delta T_A-\Delta T_B>30$ be satisfied. By satisfying the relationship, the above-described effects become further conspicuous. However, when the crystallinity of amorphous polyester is particularly low, there is the case where at least either $T_{mp}$ or $T_{ms}$ is difficult to measure (discrimination is difficult) In such a case, $\Delta T_A$ is taken as ∞ [° C.].

The heat of fusion $E_f$ of block polyester obtained in the measurement of endothermic peak of melting temperature by differential scanning calorimetry is preferably 5 mJ/mg or more, and more preferably 15 mJ/mg or more. When the heat of fusion $E_f$ is less than 5 mJ/mg, there is the possibility that the above effects due to having crystalline block cannot be sufficiently exhibited. However, the heat of fusion does not include the quantity of heat of endothermic peak of glass transition temperature. The measuring conditions of the endothermic peak of the heat of fusion are not especially restricted. The heat of fusion can be found as the value measured by, e.g., increasing the temperature of the sample block polyester to 200° C. at a temperature-up velocity of 10° C./min, lowering the temperature at a temperature-down velocity of 10° C./min, and again at a temperature-up velocity of 10° C./min.

Block polyesters are preferably linear type polymers (polymers not having a crosslinked structure). Linear type polymers have a small friction coefficient as compared with crosslinked polymers. Due to a small friction coefficient, excellent lubricating property can be obtained and the transfer efficiency of the toner obtained is further improved.

Block polyesters may have blocks other than the aforementioned crystalline blocks and amorphous blocks.

1-2. Amorphous Polyester:

Amorphous polyesters are lower in crystallinity than the crystalline blocks as described above.

Amorphous polyester is a component that mainly contributes to the improvement of the dispersibility (e.g., dispersibility of colorants, release agents, electrification inhibitors and the like), the pulverizing property of kneaded products in manufacturing a toner, fixing ability of a toner (in particular, low temperature fixing ability), transparency, mechanical characteristics (e.g., elasticity, mechanical strength and the like), is electrification property, and moisture resistance of each component constituting a toner. In other words, when amorphous polyesters described later are not contained in a toner, there are cases where characteristics required of the toner as enumerated above are difficult to be sufficiently shown.

The constitutional components of amorphous polyester are described below.

As the alcohol components constituting amorphous polyesters, those having two or more hydroxyl groups can be used, preferably diols having two hydroxyl groups. As such diol components having two hydroxyl groups, aromatic diols having an aromatic cyclic structure and aliphatic diols not having an aromatic cyclic structure are exemplified. As the aromatic diols, e.g., bisphenol A and alkylene oxide s adducts of bisphenol A are exemplified. As the aliphatic diols, such as chain diols, e.g., ethylene glycol, 1,3-propanediol, 1,2-propylene glycol, 1,3-propylene glycol, 1,4-butanediol, diethylene glycol, 1,5-pentanediol; 1,6-hexanediol, dipropylene glycol, triethylene glycol, tetraethylene glycol, 1,2-propanediol, 1,3-butanediol, 2,3-butanediol, neopentyl glycol(2,2-dimethylpropane-1,3-diol), 1,2-hexanediol, 2,5-hexane-diol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol, and cyclic diols, e.g., 2,2-bis(4-hydroxycyclohexyl)propane, alkylene oxide adducts of 2,2-bis(4-hydroxycyclohexyl)-propane, 1,4-cyclohexanediol, 1,4-cyclohexanedimethanol, hydrogenated bisphenol A, and alkylene oxide adducts of hydrogenated bisphenol A, are exemplified.

As the carboxylic acid components constituting amorphous polyester, divalent or higher carboxylic acids and derivatives thereof (e.g., acid anhydrides and lower alkyl esters) can be used, but divalent dicarboxylic acids and derivatives thereof are preferably used. The examples of dicarboxylic acids include, e.g., o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid, and derivatives of these acids (e.g., anhydrides and lower alkyl esters).

The dicarboxylic acid components constituting amorphous polyester are not particularly restricted, but it is preferred that the dicarboxylic acid components at least partially have a terephthalic acid skeleton, more preferably 80 mol % or more of the dicarboxylic acid components have a terephthalic acid skeleton, and still more preferably 90 mol % or more of the dicarboxylic acid components have a terephthalic acid skeleton. By this constitution, the toner finally obtained comes to be a toner well balanced in various characteristics required of the toner.

It is preferred that 50 mol % or more (more preferably 80 mol % or more) of the monomer components constituting amorphous polyester be the same monomer components constituting amorphous block. That is, amorphous polyester and amorphous block are preferably composed of the same monomer components. The compatibility of block polyester and amorphous polyester becomes particularly excellent by this constitution. The term "monomer components" used here does not mean the monomers used in the manufacture of block polyester and amorphous polyester, but means monomer components contained in block polyester and amorphous polyester.

Amorphous polyester may contain components other than the above diol components and dicarboxylic acid components.

The average molecular weight (weight average molecular weight, Mw) of amorphous polyesters is not particularly limited, but it is preferably from $5\times10^3$ to $4\times10^4$, and more preferably from $8\times10^3$ to $2.5\times10^4$. When the average molecular weight Mw is less than the lower limit, there is the possibility that the mechanical strength of the finally-obtained toner lowers and sufficient durability (storage stability) cannot be obtained. When the average molecular weight Mw is too small, cohesive failure is liable to occur in the fixing of the toner, and the offset resistance tends to lessen. While when the average molecular weight Mw exceeds the upper limit, intercrystalline crack is liable to occur in the fixing of the toner, and the wettability to a transfer material (a recording medium), e.g., paper, lowers, as a result the quantity of heat required in fixing increases, The glass transition temperature $T_g$ of amorphous polyester is not particularly restricted, but it is preferably from 50 to 75° C., and more preferably from 55 to 70° C. When the glass transition temperature is less than the lower limit, the storage stability (heat resistance) of the toner decreases, and there are cases where fusing occurs among toner particles according to the use environment. On the other hand, when the glass transition temperature exceeds the upper limit, low temperature fixing ability and transparency decrease. When the glass transition temperature is too high, there is the possibility that the effect of the thermal treatment of sphere-making as described later cannot be sufficiently exhibited. Glass transition temperature can be measured in accordance with JIS K 7121.

The softening temperature of amorphous polyester $T_{1/2}$ is not particularly restricted, but it is preferably from 90 to 160° C., more preferably from 100 to 150° C., and still tore preferably from 100 to 130° C. When the softening temperature is less than the lower limit, the storage stability of the toner lowers and there is the possibility that sufficient durability cannot be obtained. When the softening temperature is too low, cohesive failure is liable to occur in the fixing of the toner, and the offset resistance tends to lessen. While when the softening temperature exceeds the upper limit, intercrystalline crack is liable to occur in the fixing of the toner, and the wettability to a transfer material (a recording medium), e.g., paper, lowers, as a result the quantity of heat required in fixing increases.

Taking the softening temperature of amorphous polyester as $T_{1/2}$ (A) [° C.], and the melting temperature of the block polyester as $T_m$ (B), it is preferred that the relationship $T_m$ (B)>($T_{1/2}$ (A)+60) be satisfied, and it is more preferred the relationship ($T_{1/2}$ (A)+60)<$T_m$ (B)<($T_{1/2}$(A)+150) be satisfied. By satisfying the relationship, the amorphous polyester can be thoroughly softened while ensuring the stability of configuration of the toner powder in a certain degree by the block polyester at relatively high temperature. As a result, the viscosity of the toner particles can be made relatively low near the fixing temperature of the toner and the stress relaxation time of the toner can be prolonged. Further, the thermal sphere-making treatment described later can be carried out efficiently, and the degree of circularity of the toner (toner particles) finally obtained can be further improved by satisfying the above relationship. The toner can exhibit excellent fixing ability in a broad temperature range by satisfying the above relationship.

The softening temperature $T_{1/2}$ can be found as the temperature of the point on the flow curve corresponding to h/2 of the flow chart for analysis which can be obtained by measuring by using a flow tester on conditions of a sample amount of 1 g, pit of the die of 1 mm, length of the die of 1 mm, load of 20 kgf, preheating time of 300 seconds, temperature at starting of measurement of 50° C., and velocity of temperature-up of 5° C./min.

Amorphous polyesters are preferably linear type polymers (polymers not having a crosslinked structure). Linear type polymers have a small friction coefficient as compared with crosslinked polymers. Due to a small friction coefficient, excellent lubricating property can be obtained and the transfer efficiency of the toner obtained is further improved.

As has been described, when block polyesters and amorphous polyesters are used in combination, the characteristics of block polyesters as mentioned above and the characteristics of amorphous polyesters can be compatible, by which it becomes possible for the toner finally obtained to possess resistance against mechanical stresses (to have sufficient physical stability) and show satisfactory fixing ability (fixing strength) in a broad temperature range.

The compounding ratio of block polyester and amorphous polyester is preferably from 5/95 to 45/55 by weight, and more preferably from 10/90 to 30/70. When the compounding ratio of block polyester is too low, the synergistic effect as described above cannot be sufficiently shown, and there is the possibility that the offset resistance of the toner cannot be improved sufficiently. On the other hand, when the compounding ratio of amorphous polyester is too low, the synergistic effect as described above cannot be sufficiently shown, and there is the possibility that satisfactory low temperature fixing ability and transparency cannot be obtained. Further, when the compounding ratio of amorphous polyester is too low, there is the case where efficient and uniform pulverization is difficult in the pulverization process in the manufacture of toner.

Resins (binder resins) may contain components other than the aforementioned polyester resins.

As the resin components other than polyester resins (the third resin components), e.g., homopolymers or copolymers containing styrene or a styrene substitution product, e.g., polystyrene, poly-α-methylstyrene, chloropolystyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic ester copolymers, styrene-methacrylic ester copolymers, styrene-acrylic ester-methacrylic ester copolymers, styrene-α-methyl chloroacrylate copolymers, styrene-acrylonitrile-acrylic ester copolymers, and styrene-vinylmethyl ether copolymers, epoxy resins, urethane-modified epoxy resins, silicone-modified epoxy resins, vinyl chloride resins, rosin-modified maleic acid resins, phenyl resins, polyethylene, polypropylene, ionomer resins, polyurethane resins, silicone resins, ketone resins, ethylene-ethyl acrylate copolymers, xylene resins, polyvinyl butyral resins, terpene resins, phenol resins, aliphatic or alicyclic hydrocarbon resins are exemplified. These resins can be used either individually or as a combination of two or more thereof.

The content of these resins in the materials is not especially restricted, but the content is preferably from 50 to 98 wt. %, and more preferably from 85 to 97 wt. %. When the content of resins is less than the lower limit, there is the possibility that the functions of resins (e.g., good fixing ability in a broad temperature range) cannot be sufficiently shown. On the other hand, when the content of resins exceeds the upper limit, the contents of the components other than resins, e.g., colorants, relatively lower, and it becomes difficult to sufficiently show the characteristics of toners, e.g., coloring.

As the colorants, pigments and dyes etc. can be used. The examples of pigments and dyes include, e.g., carbon black, spirit black, lamp black (C.I. No. 77266), magnetite, titanium black, chrome yellow, zinc chrome, cadmium yellow, mineral fast yellow, navel yellow, Naphthol Yellow S, Hansa Yellow G, Permanent Yellow NCG, chrome yellow, benzidine yellow, quinoline yellow, Tartrazine Lake, chrome orange, molybdenum orange, Permanent Orange GTR, Pyrazolone Orange, Benzidine Orange G, cadmium red, Permanent Red 4R, Watchung Red Calcium Salt, eosine lake, Brilliant Carmine 3B, manganese violet, Fast Violet B, Methyl Violet Lake, Prussian blue, cobalt blue, Alkali Blue Lake, Victoria Blue Lake, Fast Sky Blue, Indanthrene Blue BC, ultramarine, aniline blue, Phthalocyanine Blue, chalcoil blue, chrome green, chromium oxide, Pigment Green B, Malachite Green Lake, Phthalocyanine Green, Final Yellow Green G, Rhodamine 6G, quinacridone, Rose Bengale (C.I. 45432), C.I. Direct Red, C.I. Direct Red 4, C.I. Acid Red, C.I. Basic Red, C.I. Mordant Red 30, C.I. Pigment Red 48:1, C.I. Pigment Red 57:1, C.I. Pigment Red 122, C.I. Pigment Red 184, C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15;1, C.I. Pigment Blue 15:3, C.I. Pigment Blue 5:1, C.I. Direct Green 6, C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, Nigrosine Dye (C.I. No. 50415B), metal complex dyes, metal oxides, e.g., silica, aluminum oxide, magnetite, maghemite, various ferrites, cupric oxide, nickel oxide, zinc oxide, zirconium oxide, titanium oxide, and magnesium oxide, and magnetic materials containing magnetic metals, e.g., Fe, Co or Ni. These pigments and dyes can be used alone or in combination of two or more.

Since the binder resins in the present invention are great in intermolecular bonding strength and highly crystalline polymers, the lowering breadth of $T_g$ can be lessened when the molecule is designed to lower Tm by lowering the molecular weight, therefore, low Tm and low $T_g$ can be compatible. Further, the melt viscosity at running point of 50% can be made from $2\times10^2$ to $3\times10^4$ Pa.s, thus, the toner of the invention is preferred for oil-less fixing.

The weight average molecular weight (Mw) of the binder resins of the present invention is from 5,000 to 100,000, preferably from 6,000 to 70,000. When the weight average molecular weight (Mw) is smaller than 5,000, there arises a problem in hot offset resistance, since the internal cohesive strength of the toner becomes too weak. While when the weight average molecular weight is greater than 100,000, the production and pulverization are deteriorated.

The toner of the present invention has a softening temperature (Tm) of from 90 to 150° C., preferably from 100 to 140° C., and more preferably from. 100 to 130° C. When the softening temperature (Tm) is lower than 90° C., there arises a problem in hot offset resistance, while when it is higher than 150° C., fixing strength lowers.

The toner of the present invention has a glass transition temperature ($T_g$) of from 50 to 75° C., preferably from 55 to 70° C. When the glass transition temperature ($T_g$) is lower than 55° C., heat storage stability lowers, and when it is higher than 75° C., there arises a problem in productivity, e.g., pulverization.

The toner of the present invention may contain a charge controlling agent (CCA), and if necessary, a release agent, a dispersant, and magnetic particles. These compounds may be dispersed in the starting material polyols, alternatively they may be arbitrarily blended by kneading after forming the resin.

Charge controlling agents (CCA) are not particularly restricted, and various kinds of organic and inorganic compounds can be used so long as they can give positive or negative charge by frictional electrification.

As the examples of positive charge controlling agents, e.g., Nigrosine Base EX (manufactured by Orient Chemical Industry Co., Ltd.), quaternary ammonium salt P-51 (manufactured by Orient Chemical Industry Co., Ltd.), Nigrosine Bontoron N-01 (manufactured by Orient Chemical Industry Co., Ltd.), Sudan Chief Schwartz BB (Solvent Black 3: Color Index 26150), Fetschwartz HBN (C.I. No. 26150), Brilliant Spirits Schwartz TN (manufactured by Farben Fabriken Bayer A. G.), and Zapon Schwartz X (manufactured by Farberke Hoechst A. G.), in addition, alkoxylated amine, alkylamide, and molybdic acid chelate pigments are exemplified. Of these compounds, quaternary ammonium salt P-51 is preferably used.

As the examples of negative charge controlling agents, e.g., Oil Black (Color Index 26150), Oil Black BY (manufactured by Orient Chemical Industry Co., Ltd.), Bontoron S-22 (manufactured by Orient Chemical Industry Co., Ltd.), salicylic acid metal complex E-81 (manufactured by. Orient Chemical Industry Co., Ltd.), thioindigo series pigments, sulfonylamine derivatives of copper phthalocyanine, Spiron Black TRH (manufactured by HODOGAYA CHEMICAL Co., Ltd.), Bontron S-34 (manufactured by Orient Chemical Industry Co., Ltd.), Nigrosine SO (manufactured by Orient Chemical Industry Co., Ltd.), Celesschwartz (R) G (manufactured by Farben Fabriken Bayer A. G.); Chromogen-schwartz ETOO (C.I. No. 14645), and Azo Oil Black (R) (manufactured by National Aniline Co.) are exemplified. Of these compounds, salicylic acid metal complex E-81 is preferably used.

These charge controlling agents can be used either individually or as a combination of two or more thereof, and the addition amount of charge controlling agents added to a binder resin is from 0.001 to 5 parts by weight per 100 parts by weight of the binder resin, preferably 0.001 to 3 parts by weight.

The binder resin which is used in the toner of the present invention is excellent in heat melt characteristics according to the molecular weight range, and a release agent is not necessary according to the viscoelastic characteristics in the fixing temperature range, but when a release agent is used, the amount is 4 parts by weight (4 wt. %) or less per 100 parts by weight of the binder resin, and preferably from 0 to 3 parts by weight.

The specific examples of release agents include paraffin waxes, polyolefin waxes, modified waxes having an aromatic group, hydrocarbon compounds having an alicyclic group, natural waxes, long chain carboxylic acids having a long chain hydrocarbon chain having 12 or more carbon atoms [$CH_3(CH_2)_{11}$ or $CH_3(CH_2)_{12}$ or higher aliphatic carbon chain], the esters thereof, metal salts of fatty acid, fatty acid amide and fatty acid bisamide. Compounds having different softening temperatures may be used as mixture. The specific examples of paraffin waxes include paraffin waxes (manufactured by NIPPON OIL COMPANY LIMITED), paraffin waxes (manufactured by Nippon Seiro Co., Ltd.), micro-wax waxes (manufactured by NIPPON OIL COMPANY LIMITED), micro-crystalline waxes (manufactured by Nippon Seiro Co., Ltd.), hard paraffin waxes (manufactured by Nippon Seiro Co., Ltd.), PE-130 (manufactured by Hoechst A. G.), Mitsui Hi-Wax 110P (manufactured by Mitsui Petrochemical Industries, Ltd.), Mitsui Hi-Wax 220P (manufactured by Mitsui Petrochemical Industries, Ltd.), Mitsui Hi-Wax 660P (manufactured by Mitsui Petrochemical Industries, Ltd.), Mitsui Hi-Wax 210P (manufactured by Mitsui Petrochemical Industries, Ltd.), Mitsui Hi-Wax 320P Mitsui Hi-Wax 410P (manufactured by Mitsui Petrochemical Industries, Ltd.), Mitsui Hi-Wax 420P (manufactured by Mitsui Petrochemical Industries, Ltd.), modified wax JC-1141 (manufactured by Mitsui Petrochemical Industries, Ltd.), modified wax JC-2130-(manufactured by Mitsui Petrochemical Industries, Ltd.), modified wax JC-4020 (manufactured by Mitsui Petrochemical Industries, Ltd.), modified wax JC-1142 (manufactured by Mitsui Petrochemical Industries, Ltd.), modified wax JC-5020 (manufactured by Mitsui Petrochemical Industries, Ltd.), beeswax, carnauba wax and montan wax. As fatty acid metal salts, zinc stearate, calcium stearate, magnesium stearate, zinc oleate, zinc palmitate, and magnesium palmitate are exemplified.

As polyolefin waxes, e.g., low molecular weight polypropylene, low molecular weight polyethylene, oxidation type polypropylene and oxidation type polyethylene are exemplified. The specific examples of polyolefin-based waxes include non-oxidation type polyethylene waxes, e.g., Hoechst Wax PE520, Hoechst Wax PE130, Hoechst Wax PE190 (manufactured by Hoechst A. G.), Mitsui Hi-Wax 200, Mitsui Hi-Wax 210, Mitsui Hi-Wax 210M, Mitsui Hi-Wax 220, Mitsui Hi-Wax 220M (manufactured by Mitsui Petrochemical Industries, Ltd.), and & SANWAX 131-P, SANWAX 151-P, SANWAX 161-P (manufactured by Sanyo Chemical Industries Co., Ltd.), oxidation type polyethylene waxes, e.g. Hoechst Wax PED121, Hoechst Wax PED153, Hoechst Wax PED521, Hoechst Wax PED522, Hoechst Wax Ceridust 3620, Hoechst Wax Ceridust VP130, Hoechst Wax Ceridust VP5905, Hoechst Wax Ceridust VP9615A, Hoechst Wax Ceridust TM9610F, Hoechst Wax Ceridust 3715 (manufactured by Hoechst A. G.), Mitsui Hi-Wax 420M (manufactured by Mitsui Petrochemical Industries, Ltd.), and SANWAX E-300, SANWAX E-250P (manufactured by Sanyo Chemical Industries Co., Ltd.), non-oxidation type polypropylene waxes, e.g., Hoechst Wachs PP230 (manufactured by Hoechst A. G.), VISCOL 330-P, VISCOL 550-P, VISCOL 660-P, (manufactured by Sanyo Chemical Industries Co., Ltd.), and oxidation type polypropylene waxes, e.g., VISCOL TS-200 (manufactured by Sanyo Chemical Industries Co., Ltd.). These release agents can be used alone or in combination of two or more. As the release agent added according to necessity, it is preferred to use a compound having a softening temperature (a melting temperature) of from 40 to 130° C., preferably from 50 to 120° C. A softening temperature is an endothermic main peak value on the DSC endothermic curve measured with "DSC120" (a product of Seiko Instruments Inc,).

The mother particles of the toner of the present invention car be obtained by kneading the above compositions, melting, then pulverizing the obtained product by finely grinding member and classifying. A flowability improver may be externally added to the compositions for improving the flowability.

Organic and inorganic fine particles can be used as the flowability improver. For instance, fluorine resin powders, e.g., vinylidene fluoride fine powders, polytetrafluoroethylene fine powders, acrylate resin fine powders; fatty acid metal salts, e.g., zinc stearate, calcium stearate, lead stearate; metal oxides, e.g., iron oxide, aluminum oxide, titanium oxide, zinc oxide: and surface-treated silica obtained by treating silica fine powders manufactured by a wet or dry manufacturing process with a silane coupling agent, a titanium coupling agent or a silicone oil, are exemplified as flowability improvers. These compounds are used either individually or as a combination of two or more thereof.

Preferred flowability improvers are fine powders manufactured by a vapor phase oxidation method of a silicon halogen compound, i.e., so-called dry process silica or fumed silica, which can be manufactured by well-known methods, for example, a method which utilizes heat decomposition oxidation reaction in oxyhydrogen flame of silicon tetrachloride gas, and fundamental reaction formula is as follows.

$$SiCl_4+2H_2+O_2 \rightarrow SiO_2+4HCl$$

Further, in this manufacturing process, it is also possible to obtain complex fine powders of silica with other metal oxides by using other metal halogen compounds, e.g., aluminum chloride or titanium chloride, together with a silicon halogen compound, and these complex fine powders are also included in the scope of the invention. It is preferred for these silica fine powders to have an average primary particle size of from 0.001 to 2 μm, particularly preferably from 0.002 to 0.2 μm. As commercially available silica fine powders manufactured by a vapor phase oxidation method of a silicon halogen compound that are used in the present invention, the following commercial products are exemplified. For instance, AEROSIL 130, AEROSIL 200, AEROSIL 300, AEROSIL 380, TT600, MOX170, MOX80, and COK84 (manufactured by Nippon Aerosil Co., Ltd.), Ca—O—SiL M-5, MS-7, MS-75, HS-5 and EH-5 (manufactured by CABOT Co.), Wacker HDK N20 V15, N20E, T30 and T40 (manufactured by WACKER-CHEMIE GMBH), D-C Fine Silica (manufactured by Dow Corning Co.), and Fransol (manufactured by Fransil Co.) are exemplified.

It is more preferred to use the silica fine powders manufactured by a vapor phase oxidation method of a silicon halogen compound subjected to hydrophobitization treatment. Of the hydrophobitization-treated silica fine powders, those treated so as to have a hydrophobitization degree measured by a methanol titration test of from 30 to 80 are particularly preferred. The hydrophobitization treatment is performed by chemically treating the silica fine powders with organic silicon compounds that react with the silica fine powders or physically adsorbed onto the silica fine powders. A preferred method is treating the silica fine powders manufactured by a vapor phase oxidation method of a silicon halogen compound with an organic silicon compound.

The examples of such organic silicon compounds include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilyl acrylate, vinyldimethylacetoxysilane, dimethylethoxysilane, dimethyldimethoxysilane, diphenyldiethoxysilane, hexamethyldisilazane, 1,3-divinyltetramethyldisiloxane 1,3-diphenyltetramethyldisiloxane, and dimethylpolysiloxane having from 2 to 12 siloxane units per a molecule, wherein every unit at terminal has a hydroxyl group bonded to Si. These compounds are used either individually or a combination of two or more thereof.

Silica fine powders subjected to hydrophobitization treatment have a particle size of from 0.003 to 0.1 μm, preferably from 0.005 to 0.05 μm. As commercially available products, there are Taranocks 500 (manufactured by Tarco Co.) and AEROSIL R-972 (manufactured by Nippon Aerosil Co., Ltd.).

The addition amount of flowability improvers is from 0.01 to 5 parts by weight per 100 parts by weight of the binder resin, preferably from 0.1 to 3 parts by weight. When the addition amount is less than 0.01 parts by weight, flowability is not improved, and when it is more than 5 parts by weight, fog or blotting occurs or the scattering of the toner in the machine is accelerated.

The image-forming apparatus according to the present invention for forming an image with the toner of the present invention is described below.

As is not shown in a drawing, similarly to conventional image-forming apparatus, the image-forming apparatus of the invention comprises at least an image carrier on which an electrostatic latent image is formed, a developing unit which develops the electrostatic latent image on the image carrier to form a toner image by a toner, a transferring unit which transfers the toner image on the image carrier to a recording medium, e.g., paper, and a fixing unit which fixes the toner image transferred to the recording medium by heating. In that case, since the image carrier, the developing unit and the transfer unit are the same as those conventionally used description of each unit is omitted.

The fixing unit is equipped with oil-less two rollers. However, the present invention is not limited thereto.

Figure 1:
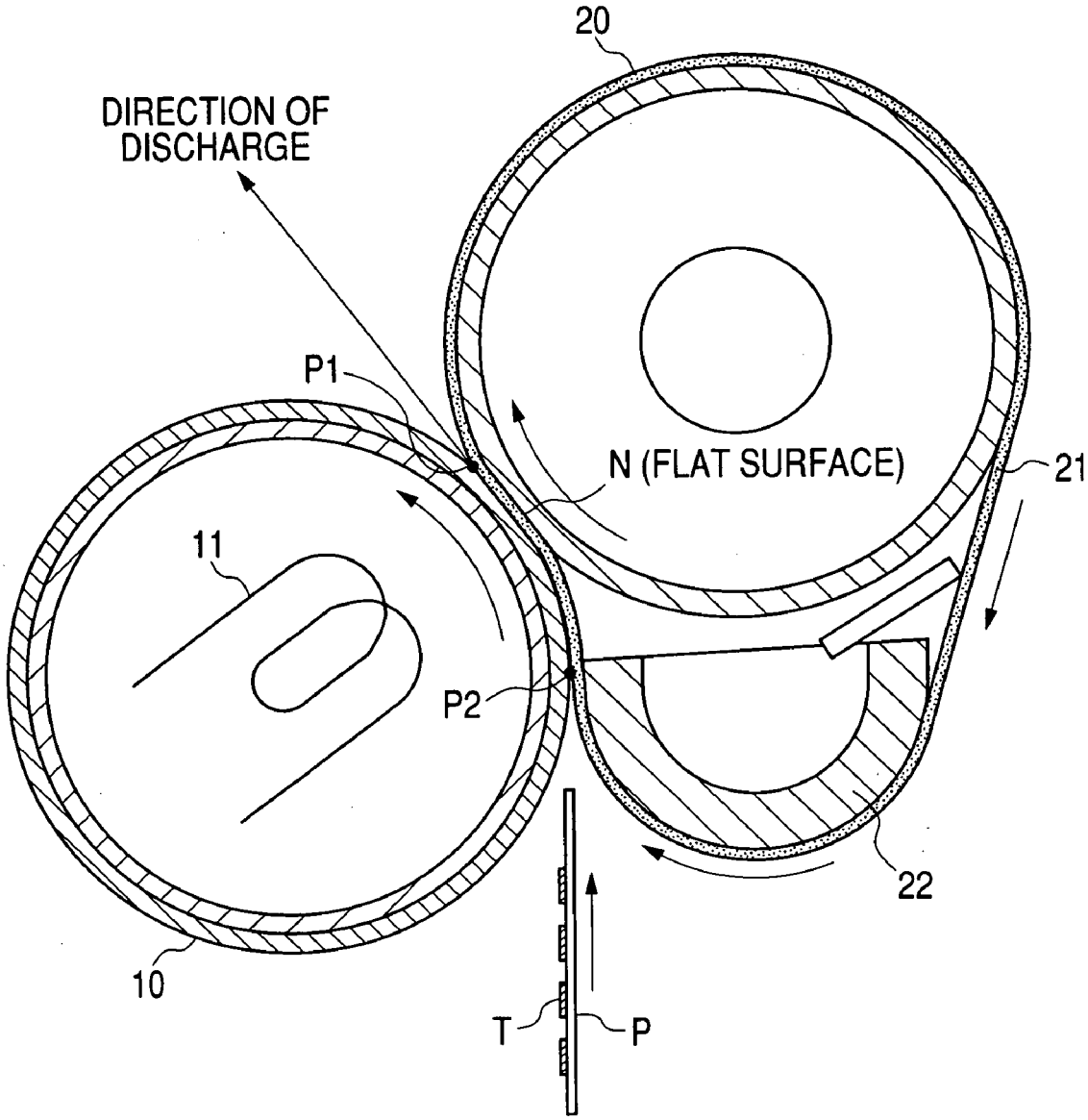
FIG. 1 is a drawing typically showing an example of the fixing unit of an image-forming apparatus to which the toner of the first invention is applied.

FIG. 1 is a drawing typically showing an example of a fixing unit of the first invention. In FIG. 1, 10 is a heating roller (a heating member), 11 a heater, 20 a driving brace member (a pressing roller, a pressing member), 21 a fixing belt, 22 a brace member, P a paper (a recording medium), T unfixed toner on paper P, and N is fixing nip part where fixing belt 21 and heating roller 10 are brought into contact with pressure.

The surface hardness of heating roller 10 and the surface hardness of driving brace member 20 are set to be the same and the configuration of the nip part is set to be plane configuration. Brace member 22 is also in contact with heating roller 10. Driving brace member 20 and brace member 22 both function as brace members to extend fixing belt 21. A part of fixing belt 21 is wound around heating roller 10 between point P1 where fixing belt 21 is apart from heating roller 10 and point P2 where fixing belt 21 starts to contact with heating roller 10. In this example, heating roller 10 comes to function as a pressing member together with driving brace member 20 and brace member 22.

When driving brace member 20 is driven to rotate clockwise, fixing belt 21 also rotates clockwise, and the rotary driving force of driving brace member 20 is transferred to heating roller 10 by the rotation of fixing belt 21, thus heating roller 10 rotates anticlockwise. In this state, paper P (a recording medium) on which unfixed toner T is adhered is coming in from the lower side in FIG. 1 at point P2 between heating roller 10 and fixing belt 21, and paper P is discharged at point P1 in the paper discharge direction (the level direction of nip part N). Unfixed toner T is fixed by pressure with heating between point P2 and point P1.

As described above, the toner of the first invention is fixed on paper P without causing offset by the increase of elasticity and viscosity, although the toner is in the state of being in contact with fixing roller 10.

According to the image-forming apparatus of the first invention, a high quality toner image having good transparency can be formed while maintaining good fixing ability and preventing fattening of characters by organically combining a toner improved in surface smoothness of a fixing-surface, fixing strength of a toner, prevented in fattening of characters, and improved in transparency as described above, with a fixing unit equipped with a belt.

Figure 2:
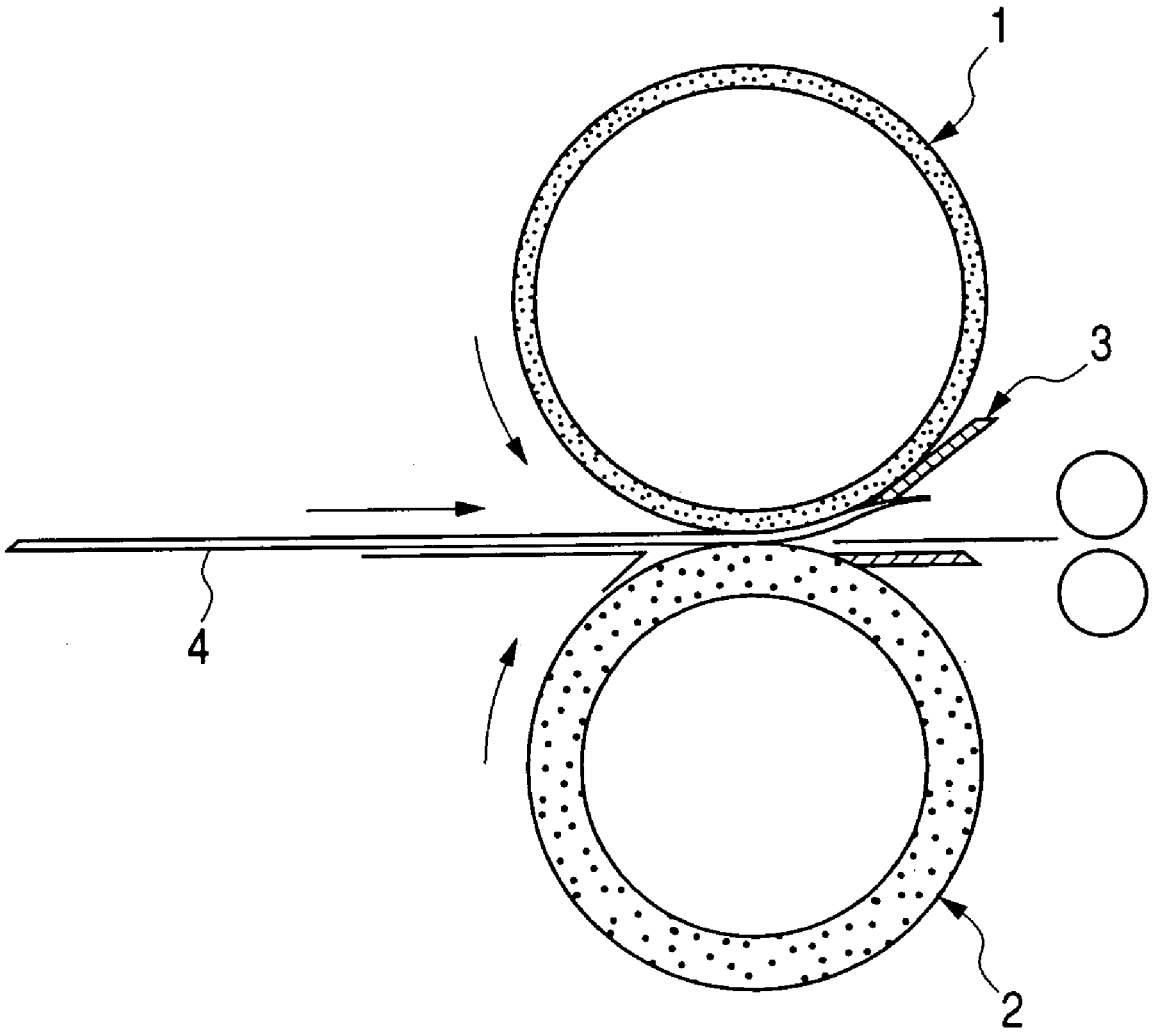
FIG. 2 is a drawing typically showing an example of the fixing unit of an image-forming apparatus to which the toner of the second invention is applied.

FIG. 2 is a drawing typically showing an example of a fixing unit of the second invention. In FIG. 2, 1 is a fixing roller (a heating roller), 2 is a backup roller (a pressing roller), 3 is a releasing pawl, and 4 is a recording medium, e.g., paper.

Fixing roller 1 may be either a monolayer type or a multilayer type. A monolayer type roller comprises a core bar having a diameter of from 15 to 50 mm and a built-in heating member, and a silicone rubber layer or a fluorine rubber layer having a thickness of from 0.1 to 20 mm, preferably from 0.5 to 3 mm, laminated around the core bar. A multilayer type roller comprises a core bar having a diameter of from 15 to 50 mm and a built-in heating member, an elastic layer having a thickness of from 0.1 to 20 mm, preferably from 0.5 to 3 mm, and a coat layer having a thickness of from 0.05 to 2 mm, preferably from 0.1 to 1 mm, laminated around the core bar in sequence. As the combination of the elastic layer and the coat layer, the following combinations are exemplified.

(1) An elastic layer comprising a silicone resin, and a coat layer comprising a fluorine resin;
(2) An elastic layer comprising a silicone rubber, and a coat layer comprising a fluorine rubber; and
(3) An elastic layer comprising a silicone rubber, and a coat layer comprising a silicone rubber and a fluorine rubber.

The rubber layer in a monolayer and the elastic layer in multilayers are layers having rubber hardness of 30° or less, preferably 15° or less, in JIS A hardness.

Backup roller 2 may be either a monolayer type or a multilayer type. A monolayer type roller comprises a core bar having a diameter of from 15 to 50 mm, and a silicone rubber layer or a fluorine rubber layer having a thickness of from 0.1 to 20 mm, preferably from 0.5 to 3 mm, laminated around the core bar. A multilayer type roller comprises a core bar having a diameter of from 15 to 50 mm, an-elastic layer having a thickness of from 0.1 to 20 mm, preferably from 0.5 to 3 mm, and a coat layer having a thickness of from 0.05 to 2 mm, preferably from 0.1 to 1 mm, laminated in sequence around the core bar. As the combination of the elastic layer and the coat layer, the following combinations are exemplified.

(1) An elastic layer comprising a silicone sponge, and a coat layer comprising high releasable silicone laminated in sequence;

(2) An elastic layer comprising silicone rubber, and a coat layer comprising fluorine rubber laminated in sequence;

(3) An elastic layer comprising silicone rubber, and a coat layer comprising fluorine rubber latex and fluorine resin laminated in sequence; and (4) An elastic layer comprising silicone sponge rubber, and a coat layer comprising fluorine resin (PFA tube) laminated in sequence.

The rubber layer in a monolayer and the elastic layer in multilayers are layers having rubber hardness of 30° or less, preferably 15° or less, in JIS A hardness.

The pressure (linear pressure) of fixing roller 1 and backup roller 2 is from 0.2 to 2 kgf/cm, preferably from 0.3 to 1 kgf/cm, the nip breadth is from 1 to 20 mm, preferably from 4 to 10 mm. The velocity of the rollers may be set arbitrarily so that the time of transiting nip becomes from 10 to 150 msec, preferably from 30 to 100 msec.

As described above, the toner of the second invention is fixed on recording medium 4 without causing offset by the increase of elasticity and viscosity, although the toner is in the state of being in contact with fixing roller (heating roller) 1. Since the toner of the invention is excellent in offset resistance at low temperature and high temperature, the fixing unit of the image-forming apparatus in the present invention can be made an oil-less fixing unit not necessitating coating of a release agent, e.g., silicone oil, on the surface of the fixing roller.

According to the image-forming apparatus of the second invention, a high quality toner image having good transparency can be formed while maintaining oil-less and good fixing ability and preventing fattening of characters by organically combining a toner improved in surface smoothness of a fixing surface, fixing strength of a toner, prevented in fattening of characters, and improved in transparency as described above, with an oil-less two-roller fixing unit.

Well-known methods can be applied to the measurement of the physical properties of the toner of the present invention, e.g., softening temperature (Tm), glass transition temperature (Tg), molecular weight, particle size, storage elastic modulus G' and loss elastic modulus G", and the evaluation of fixing ability. One example of these methods is described in Experimental Examples later.

Experimental Examples of the Invention

The toners of the present invention are specifically described with reference to Experimental Examples In the first place, the measuring methods of physical properties, dynamic viscoelasticity, the evaluation of the good region of offset at fixing time, and the evaluation of transparency (HAZE value) of the toners in Experimental Examples of the invention are described.

(1) Measurement of Softening Temperature (Tm, Melting Temperature) (° C.)

The softening temperature of a toner (Tm) is measured by the following instrument and conditions.

(a) Measuring Instrument

Constant load extrusion capillary rheometer, Flow Tester CFD-500D manufactured by Shimadzu Corporation (b) Preparation of a Measuring Sample As the measuring sample, about 1 g of a toner is compression-molded to make a cylindrical sample fitting in with the inside diameter of the cylinder of Flow Tester.

(c) Measuring Condition

Load: 20 kgf, pit of the die: 1 mm, length of the die: 1 mm (d) Computing method of Tm A 1/2 method (2) Measuring Method of Glass Transition Temperature ($T_g$) (° C.)

The glass transition temperature of a toner is measured by the following instrument and condition.

(a) Measuring Instrument

Differential scanning calorimeter DSC220C/EXTRa 6000 PC station manufactured by Seiko Instruments Inc.

(b) Preparation of a Measuring Sample

As the measuring sample, 10 mg of the toner is sealed in an aluminum sample container.

(c) Measuring Temperature

From 20° C. (starting temperature of measurement) to 200° C. (finishing temperature of measurement)

(d) Velocity of Temperature Up

10° C./min (e) $T_g$

The temperature at the position where endothermic reaction corresponding to glass transition temperature occurs (the shoulder position of the endothermic curve) is taken as $T_g$.

(3) Measurement of Molecular Weight Distribution

A sample for GPC is prepared by dissolving 5 mg of a binder resin in 5 g of THF, and filtering THF-insoluble substance and contaminated products through a membrane filter having a pore diameter of 0.2 μm. The thus-prepared sample (THF-soluble contents) is measured by GPC by the following conditions.

(a) Column

Shodex (GPC) KF806M+KF802.5, manufactured by Showa Denko Co., Ltd.

(b) Temperature of Column

30° C.

(c) Solvent

THE (tetrahydrofuran)

(d) Flowing Velocity 1.0 ml/min (e) Detector

RI detector (f) Standard Sample

Monodispersed polystyrene standard sample (weight average molecular weight; from 580 to 3,900,000)

(4) Measurement of Particle Size

A particle size in the present invention means an "average particle".

A particle size is obtained by measuring relative weight distribution by particle size with Coulter Multisizer III type (manufactured by Coulter, Inc) by a 100 μm aperture tube. Further, the particle sizes of external additives, e.g., silica particles, are measured by an electron microscope.

(5) Measurement of Dynamic Viscoelasticity by Step Strain

The dynamic viscoelasticity of the toner of the present invention is obtained by measuring dynamic viscoelasticity with the following viscoelasticity measuring instrument by step strain by the following conditions.

(a) viscoelasticity Measuring Instrument

Viscoelasticity measuring instrument is ARES viscoelasticity measuring system (ARES viscoelasticity measuring instrument, manufactured by Rheometric Scientific FE Co.).

(b) Jigs Used

Two parallel plates of top and bottom (diameter; ϕ25 mm) are used.

(c) Preparation of Measuring Sample

About 1 g of a toner is put on the bottom plate of the parallel plates, the toner is heated with a heater to the starting temperature of measurement, and the top plate of the parallel plates is put on the toner to press the toner when the toner becomes a little soft. The toner protruding from the parallel plates is removed by trimming, and the toner is fitted in with the peripheral shape of the s parallel plates (i.e., the diameter of the parallel plates), and the height of the sample is adjusted to 1.0 to 2.0 mm (the gap between the top and bottom plates), to thereby prepare a cylindrical sample.

(d) Measuring Frequency

The measuring frequency is set at 1 rad/sec (1 Hz=6.28 rad/sec).

(e) Measuring Temperature

The measuring temperature is 180° C. constantly in the present invention, In the first invention, the temperature corresponds to a fixing setting temperature (a center value of controlled surface temperature of the heat roller).

(f) Measuring Strain

Only the bottom plate of the parallel plates is rotated to give strain without rotating the top plate. At this time, the temperature is maintained constant and gradually greater strain is given to the measuring sample (strain of from 0.1 to 200%) by strain-dependency mode (strain sweep). And the maximum strain of the storage modulus G' of dynamic viscoelasticity in a linear region and the minimum strain in a nonlinear region (the value of nonlinear monitor is 0.06 or more) to the given strain are found. These maximum strain and minimum strain were taken as the measuring strains at measuring time of step strain.

In the next place, G' (L1) is measured by applying the thus-obtained maximum strain in a linear region in initial 5 minutes from the start of measurement, G' (NL) is measured by applying the similarly obtained strain in a nonlinear-region in next 5 minutes, and G' (L2) is measured by applying the initial maximum strain in a linear region in next 5 minutes. And, G" (NL) in a nonlinear region is taken as the value after 600 sec from the start of measurement, and the variation of G' (NL) is taken as the variation of from 400 to 600 sec from the start of the measurement (200 sec in a nonlinear region).

(6) Measuring Method of Fixing Ability (a) Preparation of Image for Evaluating Fixing Ability A so-called solid image was formed with a color laser printer LP-3000C (manufactured by Seiko Epson Corporation), from which a fixing part was taken away, and J paper (manufactured by FUJI XEROX OFFICE SUPPLY) as paper for evaluation. In the present invention, the toner was uniformly adhered on the J paper to thereby form a so-called solid image, and the image-forming conditions were adjusted so that the adhered amount of the toner on the solid image was 0.4 mg/cm$^2$. Subsequently, a 30% half tone image by isolated dot of 600 dpi of definition was formed in the 20 mm square region at the position 10 mm from the end of the paper and this half tone image was used as the image for evaluating fixing ability.

(b) Fixation of Image for Evaluating Fixing Ability

A fixing unit was detached from color laser printer KL-2010 manufactured by KONICA MINOLTA HOLDINGS, INC. and this fixing unit was used for the fixation of the image for evaluating fixing ability. The fixing unit is a heating roller fixing unit comprising a heating roller and a pressing roller. The fixing unit was modified to be capable of being driven independently by external driving gear, and also to be capable of adjusting the fixing nip-transiting time, and further, to be capable of controlling the surface temperature of the heating roller (fixing roller) on the side which was contiguous to the image for evaluating fixing ability on J paper from 100° C. to 200° C. Further, the coating member of coating silicone oil on the surface of the fixing roller was detached (the state of not mounting an oil pad) and 1,000 sheets of A4 size blank paper not printed were passed, and the surface of the fixing roller was cleaned With isopropyl alcohol to remove silicone oil from the fixing roller. The surface of the fixing roller was cleaned with isopropyl alcohol every time when the image for evaluating fixing ability transited the fixing unit hereafter, wiped with dry cotton cloth, thereby the surface of the fixing roller was maintained in a s silicone oil-free state.

Thus, fixing was performed by passing the image for evaluating fixing ability on J paper through the fixing unit having the fixing roller from the surface of which. silicone oil was removed at fixing nip-transiting time of 50 mm/sec so that the surface on which unfixed toner was adhered (the image for evaluating fixing ability) was the heating roller side.

(c) Measurement of Transparency (HAZE Value)

Image-forming conditions were adjusted so that the adhesion amount of the toner on a solid image became 0.7 mg/cm$^2$, and a solid image of 20 mm square was formed at 10 mm from the end of OHP sheet by uniformly adhering the toner. After fixing the solid image at 180° C., the HAZE value of the image was measured with a HAZE meter (HAZE METER MODEL 1001DP, manufactured by Nippon Denshoku Industries Co., Ltd.). The smaller the value, the higher is the transparency.

(d) Measurement of Surface Smoothness

The image-forming condition is adjusted so that the adhesion amount of a toner becomes 1.0 mg/cm$^2$. Subsequently, a solid image for evaluating fixing ability was formed by uniformly adhering a toner on the entire surface of an A3 size paper from the position 10 m from the end of the paper. The unfixed image sample was fixed at the surface temperature of the fixing roller of 180° C., and the glossiness of the fixed image was measured with a gloss meter (GM-26D for 75° C., manufactured by MURAKAMI COLOR RESEARCH LABORATIRT). The higher the value, the higher is the glossiness (surface smoothness is high). Regarding uniformity, the central part of every 10 cm from the end of the A3 paper was measured to measure difference.

(e) Measurement of Good Region of Fixing Strength

The image for evaluating fixing ability after fixation was rubbed five times with an eraser (ECR-502R for ink ball-point pen, manufactured by LION OFFICE PRODUCTS CORP.) with a load of 1 kg, and the residual rate of toner was measured according to image densities. Image densities before and after rubbing were measured by "X-Rite model 404" (manufactured by X-Rite Inc.), and image density residual rate was computed-by the following equation;

Residual rate=(density after rubbing/density before rubbing)×100 (%)

As the result of measurement, the temperature range in which image density residual rate was 70% or more was taken as good region of fixing strength. In the evaluation of fixing rate, minimum temperature of good fixing strength region is used as the minimum temperature of good fixing rate.

(f) Fattening of Characters

The image-forming condition was adjusted so that the adhesion amount of the toner in the solid image became 0.4 mg/cm$^2$, and striping of 1 on 10 off was formed by 600 dpi. The density of the image fixed at 180° C. was measured with a spectral color difference meter (spectrolino-aperture; 4 mm, manufactured by Gretag Macbeth).

EXAMPLES

First Invention

Experimental Examples of the toners of the first invention are described below.

The manufacture of the resins used in Experimental Examples of the toners of the first invention is described below.

Resin 1A

A mixture comprising 36 molar parts of neopentyl alcohol, 36 molar parts of ethylene glycol, 48 molar parts of 1,4-cyclohexanediol, 90 molar parts of dimethyl terephthalate, and 10 molar parts of phthalic anhydride was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 180° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 200° C. Free diol generated by the condensation reaction was discharged from the system, and the thus-obtained reaction product was taken as resin 1A. Resin 1A had a softening temperature (Tm) of 111° C., a glass transition temperature ($T_g$) of 60° C., and a weight average molecular weight (Mw) of 13,000.

Resin 2A

A mixture comprising 70 molar parts of resin 1A, 15 molar parts of 1,4-butanediol, and 15 molar parts of dimethyl terephthalate was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 200° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 220° C. Free diol generated by the condensation reaction was discharged from the system, and the thus-obtained reaction product was taken as resin 2A. Resin 2A had a softening temperature (Tm) of 149° C., a glass transition temperature ($T_g$) of 64° C., and a weight average molecular weight. (Mw) of 28,000.

The manufacture of the master batch for the toners of the first invention used in Experimental Examples is described below.

Master Batch 1A

As the colorant, 30 wt. % of pigment Toner Magenta 6B (manufactured by Clariant Japan K.K.),was added to 70 wt. % of resin 2A. The mixture was thoroughly blended by a Henschel mixer 20B (manufactured by MITSUI MINING COMPANY, LIMITED) and kneaded with a continuous system twin roll kneader (manufactured by MITSUI MINING COMPANY, LIMITED). The kneaded product was coarsely pulverized to a particle size of about 2 mm with a pulverizer (manufactured by HOSOKAWA MICRON CORPORATION), thereby master batch 1A was obtained.

Master Batch 2A

As the colorant, 30 wt. % of pigment Toner Magenta 6B (manufactured by Clariant Japan K.K.) was added to 70 wt. % of crosslinked polyester resin (manufactured by Sanyo Chemical Industries Co., Ltd.; softening temperature (Tm); 144° C., glass transition temperature ($T_g$): 60° C., weight average molecular weight (Mw): 29, 000). The mixture was thoroughly blended by a Henschel mixer 20B (manufactured by MITSUI MINING COMPANY, LIMITED) and kneaded with a continuous system twin roll kneader (manufactured by MITSUI MINING COMPANY, LIMITED). The kneaded product was coarsely pulverized to a particle size of about 2 mm with a pulverizer (manufactured by HOSOKAWA MICRON CORPORATION), thereby master batch 2A was obtained.

Manufacturing method of the toners of the first invention used in Experimental Examples is described below.

Experimental Example 1A

To 14 parts by weight of master batch 1A, 40 parts by weight of resin 1A, 52 parts by weight of resin 2A, 1.1 parts by weight of Bontron E-81 (manufactured by Orient Chemical Industry Co., Ltd.) as CCA, and 3.3 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 1A was obtained.

Experimental Example 2A

To 14 parts by weight of master batch 1A, 60 parts by weight of resin 1A, 32 parts by weight of resin 2A; 1.1 parts by weight of Bontron E-81 (manufactured by Orient Chemical Industry Co., Ltd.) as CCA, and 3.3 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 2A was obtained.

Experimental Example 3A

To 14 parts by weight of master batch 2A, 30 parts by weight of linear polyester resin (manufactured by Sanyo Chemical Industries Co., Ltd.; softening temperature (Tm): 105° C., glass transition temperature ($T_g$): 68° C., weight average molecular weight (Mw); 11,500), 62 parts by weight of crosslinked polyester resin (manufactured by Sanyo Chemical Industries Co., Ltd.; softening temperature (Tm): 144° C., glass transition temperature ($T_g$): 60° C., weight average molecular weight (Mw): 29,000), 1.1 parts by weight of Bontron E-81 (manufactured by Orient Chemical Industry Co., Ltd.) as CCA, and 3.3 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 3A was obtained.

Experimental Example 4A

To 14 parts by weight of master batch 1A, 60 parts by weight of resin 1A, 32 parts by weight of resin 2A, 1.1 parts by weight of Bontron E-81 (manufactured by Orient Chemical Industry Co., Ltd.) as CCA, and 5.6 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE-CO., LTD.), cooled to normal temperature (25° C.), pulverized with a pulverizer 200AG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 4A was obtained.

Experimental Example 5A

To 14 parts by weight of master batch 1A, 70 parts by weight of resin 1A, 22 parts by weight of resin 2A, 1.1 parts by weight of Bontron E-81 (manufactured by Orient Chemical Industry Co., Ltd.) as CCA, and 3.3 parts by weight of Carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm a were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 5A was obtained.

The variation of the storage modulus G' (NL) in a nonlinear region at 180° C. during 200 seconds and the loss modulus G" (NL) in a nonlinear region of each of these toners in Experimental Examples were measured, and the evaluation tests of surface smoothness, minimum temperature of good fixing strength, fattening of characters, and transparency (HAZE value) as described above were performed by using each of these toners. The results obtained are shown in Table 1A below.

TABLE 1A

| | Variation of G' (NL) (dyn/cm$^2$) | G" (NL) (dyn/cm$^2$) | Amount of release agent per 100 parts by weight of binder resin (parts by weight) | Uniformity of Surface Smoothness | Minimum Temperature of Good Fixing Strength | Fattening of Characters | Transparency (HAZE Value) |
|---|---|---|---|---|---|---|---|
| Experimental Example 1A | 80 | 4,800 | 3.2 | B | B | A | A |
| Experimental Example 2A | 15 | 1,600 | 3.2 | A | A | B | A |
| Experimental Example 3A | 120 | 5,130 | 3.2 | C | C | A | A |
| Experimental Example 4A | 12 | 1,550 | 5.5 | A | A | B | C |
| Experimental Example 5A | 10 | 1,200 | 3.2 | A | A | C | A |

Definition of descriptions "A", "B" and "C" in the above Table are described in the following page.

Uniformity of surface smoothness:
A: 10 or less
B: Higher than 10 and lower than 20
C: 20 or more Minimum temperature of good fixing strength:
A: 160° C. or less
B: Higher than 160° C. and lower than 180° C.
C: 180° C. or more Fattening of characters:
A: From 0.22 to 0.24
B: From 0.215 to 0.245
C: Smaller than 0.215 or greater than 0.245

Transparency (HAZE value):
A: Less than 40
B: From 40 to 60
C: More than 60

As shown in Table 1A, the variation of the storage modulus G' (NL) in a nonlinear region at 180° C. during 400 to 600 seconds after the start of measurement (during 200 seconds) was 80 dyn/cm$^2$ in Experimental Example 1A, 15 dyn/cm$^2$ in Experimental Example 2A, 120 dyn/cm$^2$ in Experimental Example 3A, 12 dyn/cm$^2$ in Experimental Example 4A, and 10 dyn/cm$^2$ in Experimental Example 5A. Further, the loss modulus G" (NL) in a nonlinear region at 180° C. was 4,800 dyn/cm$^2$ in Experimental Example 1A, 1,600 dyn/cm$^2$ in Experimental Example 2A, 5,130 dyn/cm$^2$ in Experimental Example 3A, 1,550 dyn/cm$^2$ in Experimental Example 4A, and 1,200 dyn/cm$^2$ in Experimental Example 5A.

As can be understood from the results in Table 1A, the uniformity of surface smoothness was less than 20 in Experimental Example 1A, and 10 or less in Experimental Example 2A, thus both Experimental Examples showed good results. The surface smoothness was 20 or more in Experimental Example 3A, which was not good, and 10 or less in both Experimental Examples 4A and 5A, which was good.

Minimum temperature of good fixing strength was lower than 180° C. in Experimental Example 1A, 160° C. or less in Experimental Example 2A, thus both Experimental Examples showed good results. Minimum temperature of good fixing strength was 180° C. or more in Experimental Example 3A, which was not good, and 160° C. or less in both Experimental Examples 4A and 5A, which was good.

The value of fattening of characters showed from 0.22 to 0.24 in Experimental Example 1A, which was graded "A", from 0.215 to 0.245 in Experimental Example 2A, which was within the range of grade "B", and both Experimental Examples showed good results. The value of fattening of characters showed from 0.22 to 0.24 in Experimental Example 3A, which was graded "A", from 0.215 to 0.245 in Experimental Example 4A, which was within the range of grade "B" and a good result, and in Experimental Example 5A the value was less than 0.215 or more than 0.245, which was in the range of "C" and not good.

With respect to transparency, HAZE values were less than 40 in both Experimental Examples 1A and 2A, which were good results. HAZE value in Experimental Examples 3A and 5A was less than 40 and good, and the value was more than 60 in Experimental Example 4A, thus inferior.

From these results, it was confirmed that the toners in Experimental Examples 1A and 2A could attain the expected effects.

Second Invention

Experimental Examples of the toners of the second invention are described below.

The manufacture of the resins for the toners of the second invention used in Experimental Examples is described below.

Resin 1B

A mixture comprising 36 molar parts of neopentyl alcohol, 36 molar parts of ethylene glycol, 48 molar parts of 1,4-cyclohexanediol, 90 molar parts of dimethyl terephthalate, and 10 molar parts of phthalic anhydride was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 180° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 200° C. Free diol generated by the condensation reaction was discharged from the system, and the thus-obtained reaction product was taken as resin 1B. Resin 1B had a softening temperature (Tm) of 111° C., a glass transition temperature ($T_g$) of 60° C., and a weight average molecular weight (Mw) of 13,000.

Resin 2B

A mixture comprising 70 molar parts of resin 1B, 15 molar parts of 1,4-butanediol, and 15 molar parts of dimethyl terephthalate was prepared.

A two-liter four-necked flask was equipped with a reflux condenser, a distillation column, a water separator, a nitrogen gas introducing pipe, a thermometer and a stirrer according to an ordinary method, charged with 1,000 g of the above mixture and 1 g of an esterification condensation catalyst, and esterification reaction was carried out with bleeding water and methanol generated at 200° C. from the distillation column. At the point when water and methanol stopped bleeding from the distillation column, the distillation column was detached from the two-liter four-necked flask and a vacuum pump was connected to the four-necked flask. The pressure in the system was lowered to 5 mmHg or less and the reaction system was stirred at a rotary speed of 150 rpm at 220° C. Free diol generated by the condensation reaction was discharged from the system, and the thus-obtained reaction product was taken as resin 2B. Resin 25 had a softening temperature (Tm) of 149° C., a glass transition temperature ($T_g$) of 64° C., and a weight average molecular weight (Mw) of 28,000.

The manufacture of the master batch for the toners of the second invention used in Experimental Examples is described below.

Master Batch 1B

As the colorant, 30 wt. % of pigment Toner Magenta 6B (manufactured by Clariant Japan K.K.) was added to 70 wt. % of resin 2B. The mixture was thoroughly blended by a Henschel mixer 20B (manufactured by MITSUI MINING COMPANY, LIMITED) and kneaded with a continuous system twin roll kneader (manufactured by MITSUI MINING COMPANY, LIMITED). The kneaded product was coarsely pulverized to a particle size of about 2 mm with a pulverizer (manufactured by HOSOKAWA MICRON CORPORATION), thereby master batch 1B Was obtained.

Master Batch 2B

As the colorant, 30 wt. % of pigment Toner Magenta 6B (manufactured by Clariant Japan K.K.) was added to 70 wt. % of crosslinked polyester resin (manufactured by Sanyo Chemical industries Co., Ltd., softening temperature (Tm): 144° C., glass transition temperature ($T_g$) 60° C., weight average molecular weight (Mw): 29,000). The mixture was thoroughly blended by a Henschel mixer 20B (manufactured by MITSUI MINING COMPANY, LIMITED) and kneaded with a continuous system twin roll kneader (manufactured by MITSUI MINING COMPANY, LIMITED). The kneaded product was coarsely pulverized to a particle size of about 2 mm with a pulverizer (manufactured by HOSOKAWA MICRON CORPORATION), thereby master batch 2B was obtained.

Manufacturing method of the toners used in Experimental Examples is described below.

Experimental Example 1B

To 14 parts by weight of master batch 1B, 50 parts by weight of resin 1B, 42 parts by weight of resin 2B, 1.1 parts by weight of Bontron E-81 (manufactured by Orient Chemical Industry Co., Ltd.) as CCA, and 3.3 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 1B was obtained.

Experimental Example 2B

To 14 parts by weight of master batch 1B, 70 parts by weight of resin 1B, 22 parts by weight of resin 2B, 1.1 parts by weight of Bontron E-81 (manufactured by Orient Chemical Industry Co., Ltd.) as CCA, and 3.3 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 2B was obtained.

Experimental Example 3B

To 14 parts by weight of master batch 2B, 40 parts by weight of linear polyester resin (manufactured by Sanyo Chemical Industries Co., Ltd.; softening temperature (Tm); 105° C., glass transition temperature ($T_g$): 68° C., weight average molecular weight (Mw): 11,500), 52 parts by weight of crosslinked polyester resin (manufactured by Sanyo Chemical Industries Co., Ltd.; softening temperature (Tm): 144° C., glass transition temperature ($T_g$): 60° C., weight average molecular weight (Mw); 29,000), 1.1 parts by weight of Bontron E-81 (manufactured by Orient Chemical Industry Co., Ltd.) as CCA, and 3.3 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 3B was obtained.

Experimental Example 4B

To 14 parts by weight of master batch 1B, 70 parts by weight of resin 1B, 22 parts by weight of resin 2B, 1.1 parts by weight of Bontron E-81 (manufactured by Orient Chemical Industry Co., Ltd.) as CCA, and 5.6 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 4B was obtained.

Experimental Example 5B

To 14 parts by weight of master batch 1B, 90 parts by weight of resin 1B, 2 parts by weight of resin 2B, 1.1 parts by weight of Bontron E-81 (manufactured by Orient Chemical Industry Co., Ltd.) as CCA, and 3.3 parts by weight of carnauba wax (manufactured by NIPPON WAX CORPORATION) as the release agent were added, and thoroughly blended with a Henschel mixer 20B (manufactured by MITSUI MINING COMPANY, LIMITED), melt-kneaded with a two-Shaft extruder (manufactured by TOSHIBA MACHINE CO., LTD.), cooled to normal temperature (25° C.), pulverized with a pulverizer 200AFG (manufactured by HOSOKAWA MICRON CORPORATION), and classified with a classifier 100ATP (manufactured by HOSOKAWA MICRON CORPORATION), thereby mother particles having weight D50 of 8 μm were obtained. To 100 parts by weight of the mother particles, 1 part by weight of silica RX200 (manufactured by Nippon Aerosil Co., Ltd.) was added and blended with a Henschel mixer 20B (manufactured by MITSUI MINING COMPANY, LIMITED), thereby a toner in Experimental Example 5B was obtained.

The loss modulus G" (NL) in a nonlinear region at 180° C. of each of these toners in Experimental Examples was measured, and the evaluation tests of minimum temperature of good fixing strength, fattening of characters, and transparency (HAZE value) as described above were performed by using each of these toners. The results obtained are shown in Table 1B below.

TABLE 1B

| | G" (NL) (dyn/cm$^2$) | Amount of release agent per 100 parts by weight of binder resin (parts by weight) | Minimum Temperature of Good Fixing Strength | Fattening of Characters | Transparency (HAZE Value) |
|---|---|---|---|---|---|
| Experimental Example 1B | 3500 | 3.2 | B | A | A |
| Experimental Example 2B | 1200 | 3.2 | A | B | A |
| Experimental Example 3B | 4300 | 3.2 | C | A | A |
| Experimental Example 4B | 1100 | 5.5 | A | B | C |
| Experimental Example 5B | 850 | 3.2 | A | C | A |

Definition of descriptions "A", "B" and "C" in the above Table are described in the following page.

Minimum temperature of good fixing strength;

A: 160° C. or less

B: Higher than 160° C. and lower than 180° C.

C: 18° C. or more

Fattening of characters:

A: From 0.22 to 0.24

B; From 0.215 to 0.245

C; Less than 0.215 or more than 0.245

Transparency (HAZE value):

A: Less than 40

B: From 40 to 60

C: More than 60

As shown in Table 1B, the loss modulus G" (NL) in a nonlinear region at 18° C. was 3,500 dyn/cm$^2$ in Experimental Example 1B, 1,200 dyn/cm$^2$ in Experimental Example 2B, 4,300 dyn/cm$^2$ in Experimental Example 3B, 1,100 dyn/cm$^2$ in Experimental Example 4B, and 850 dyn/cm$^2$ in Experimental Example 5B.

As can be understood from the results in Table 1B, minimum temperature of good fixing strength was lower than 180° C. in Experimental Example 1B, 160° C. or less in Experimental Example 2B, thus both Experimental Examples showed good results. Minimum temperature of good fixing strength was 180° C. or more in Experimental Example 3B, which was not good, and 160° C. or less in both Experimental Examples 4B and 5B, thus both Experimental Examples showed good results.

The value of fattening of characters showed from 0.22 to 0.24 in Experimental Example 1B, which was graded "A", from 0.215 to 0.245 in Experimental Example 2B, which was within the range of grade "B", and both Experimental Examples showed good results. The value of fattening of characters showed from 0.22 to 0.24 in Experimental Example 3B, which was graded "A", from 0.215 to 0.245 in Experimental Example 4B, which was within the range of grade "B" and a good result, and in Experimental Example 5B the value was less than 0.215 or more than 0.245, which was in the range of "C" and not good.

With respect to transparency, HAZE values were less than 40 in both Experimental Examples 1B and 2B, which were good results. HAZE value in Experimental Examples 3B and 5B was less than 40 and good, and the value was more than 60 in Experimental Example 4B, and not good.

From these results, it was confirmed that the toners in Experimental Examples 1B and 2B could attain the expected effects.

In the toner of the first invention having such a constitution, since the variation of the storage modulus (G' (NL)) in a nonlinear region at 180° C. during the given time of 200 seconds is 100 dyn/cm$^2$ or less in step strain measurement of from a linear region to a nonlinear region of viscoelastic characteristics, a nonlinear region of dynamic viscoelastic characteristics of the temperature dependency of the toner is effectively utilized in fixation by heating, thus a toner more conformable to actual behavior of toner can be obtained.

Therefore, according to the toner of the first invention, elasticity and viscosity after transiting fixing nip can be properly ensured, and it becomes possible to more effectively improve both surface smoothness of a fixing surface and fixing strength of a toner. In that case, when the variation of the storage modulus (G' (NL)) in a nonlinear region during the given time of 200 seconds is smaller than 12 dyn/cm$^2$, there arises a problem in fattening of characters and transparency, the variation is preferably 12 dyn/cm$^2$ or more.

In particular, when the loss modulus (G" (NL)) of a toner in a nonlinear region is from 1,500 to 5,000 dyn/cm$^2$, elasticity and viscosity can be securely obtained, appropriate fixing strength can be obtained in fixation by heating, fine lines are not squeezed, and fattening of characters can be effectively prevented.

Further, when the content of a release agent is more than 4 parts by weight per 100 parts by weight of the binder resin, transparency is hindered, so that transparency can be improved by setting the content of a release agent at 4 parts by weight or less.

According to the image-forming apparatus of the first invention, a high quality toner image having good transparency can be formed while maintaining good fixing ability and preventing fattening of characters by organically combining a toner improved in surface smoothness of a fixing surface, fixing strength of a toner, and prevented in fattening of characters, in addition to these, a toner improved in transparency as described above, with a fixing unit equipped with a belt.

In the toner of the second invention having such a constitution, since the loss modulus (G" (NL)) in a nonlinear region at 180° C. is from 1,000 to 4,000 dyn/cm$^2$ in step strain measurement of from a linear region to a nonlinear region of viscoelastic characteristics, a nonlinear region of dynamic viscoelastic characteristics of the strain dependency of the toner is effectively utilized in fixation by heating, thus a toner more conformable to actual behavior of toner can be obtained.

Therefore, according to the toner of the second invention, elasticity and viscosity after transiting fixing nip can be properly ensured, and it becomes possible to more effectively improve fixing strength of a toner and prevent fattening of characters.

In particular, when the content of a release agent is more than 4 parts by weight per 100 parts by weight of the binder resin, transparency is hindered, so that transparency can be improved by setting the content of a release agent at 4 parts by weight or less per 100 parts by weight of the binder resin.

In addition, when the binder resin of a toner contains a crosslinked component, the reductions of fixing strength, surface smoothness and transparency are brought about, so that it is preferred that the binder resin of the toner of the second invention should not contain a crosslinked component.

According to the image-forming apparatus of the second invention, a high quality toner image having good transparency can be formed while maintaining oil-less and good fixing ability and preventing fattening of characters by organically combining a toner improved in fixing strength of a toner, and prevented in fattening of characters, in addition to these, improved in transparency as described above, with a fixing unit equipped with oil-less two rollers.

While the present invention has been described in detail and with reference to specific embodiments thereof, it will be apparent to one skilled in the art that various changes and modifications can be made therein without departing the spirit and scope thereof.

The present application is based on Japanese Patent Applications No. 2003-053831 and 2003-053832, both thereof filed on Feb. 28, 2003, and the contents thereof are incorporated herein by reference.

What is claimed is:

1. A toner comprising a binder resin and at least a colorant, wherein the toner has a variation of its storage modulus (G' (NL)) in a nonlinear region at 180° C. during 200 seconds, in step strain measurement of from a linear region to a nonlinear region of viscoelastic characteristics, of from 12 to 100 dyn/cm$^2$.

2. The toner according to claim 1, wherein the toner has loss modulus (G" (NL)) in a nonlinear region of from 1,500 to 5,000 dyn/cm$^2$.

3. The toner according to claim 1, wherein the toner contains a release agent in an amount of 4 parts by weight or less per 100 parts by weight of the binder resin.

4. An image-forming apparatus comprising at least:

an image carrier on which an electrostatic latent image is formed;

a developing unit which develops the electrostatic latent image on the image carrier to form a toner image by a toner;

a transferring unit which transfers the toner image on the image carrier to a recording medium; and a fixing unit which fixes the toner image transferred to the recording medium by heating, wherein the toner is the toner according to any one of claims 1 to 3, wherein the fixing unit has a belt.

* * * * *